US009797652B1

(12) United States Patent
Wilkerson

(10) Patent No.: US 9,797,652 B1
(45) Date of Patent: Oct. 24, 2017

(54) SYSTEM AND METHOD FOR RAPID FLUID CHILLING AND HEATING FOR CARBONATED AND NON-CARBONATED FLUIDS

(71) Applicant: Jonathan Wilkerson, Raleigh, NC (US)

(72) Inventor: Jonathan Wilkerson, Raleigh, NC (US)

( * ) Notice: Subject to any disclaimer, the term of this patent is extended or adjusted under 35 U.S.C. 154(b) by 0 days.

(21) Appl. No.: 15/440,538

(22) Filed: Feb. 23, 2017

(51) Int. Cl.

| | |
|---|---|
| ***B67D 3/00*** | (2006.01) |
| ***F25B 21/02*** | (2006.01) |
| ***F25D 31/00*** | (2006.01) |
| ***F25B 21/04*** | (2006.01) |
| ***B67D 1/08*** | (2006.01) |
| ***B67D 1/00*** | (2006.01) |
| ***B67D 1/07*** | (2006.01) |

(52) U.S. Cl.
CPC ..... *F25D 31/002* (2013.01); *B67D 1/0062* (2013.01); *B67D 1/07* (2013.01); *B67D 1/0869* (2013.01); *F25B 21/04* (2013.01); *F25D 31/005* (2013.01); *B67D 1/0075* (2013.01); *F25B 2321/0251* (2013.01); *F25B 2321/0252* (2013.01)

(58) Field of Classification Search
CPC ..... F25D 31/002; F25D 31/005; F25B 21/04; F25B 2321/0252; F25B 2321/0251; B67D 1/07; B67D 1/0062; B67D 1/0075; B67D 1/0869; B67D 7/78; B67D 3/0035; B67D 3/0038
USPC ..... 62/3.63, 3.64
See application file for complete search history.

(56) References Cited

U.S. PATENT DOCUMENTS

| | | | | |
|---|---|---|---|---|
| 2,525,709 | A * | 10/1950 | Morrison | F25D 31/002 251/117 |
| 5,040,381 | A | 8/1991 | Hazen | |
| 5,560,211 | A * | 10/1996 | Parker | B67D 1/0869 62/137 |
| 6,119,464 | A | 9/2000 | Nakayama et al. | |
| 9,303,902 | B2 | 4/2016 | Karlstedt | |
| 9,416,340 | B2 | 8/2016 | Kyle | |
| 2006/0147601 | A1* | 7/2006 | Scullion | A23L 2/40 426/590 |
| 2006/0150637 | A1 | 7/2006 | Wauters et al. | |
| 2007/0056295 | A1* | 3/2007 | De Vilbiss | B67D 1/0869 62/3.64 |
| 2008/0006036 | A1* | 1/2008 | Askew | F24F 5/0042 62/3.3 |
| 2013/0061605 | A1* | 3/2013 | de Rochemont | B64D 15/12 62/3.5 |

(Continued)

FOREIGN PATENT DOCUMENTS

| | | | |
|---|---|---|---|
| DE | 4036210 | A1 | 5/1992 |
| DE | 202008004284 | U1 | 8/2008 |
| DE | 102007028329 | A1 | 12/2008 |

*Primary Examiner* — Mohammad M Ali
(74) *Attorney, Agent, or Firm* — Envision IP, LLC; Maulin V. Shah

(57) ABSTRACT

An invention for rapid chilling or heating of both carbonated and non-carbonated fluids is disclosed. The invention is a fluid dispensing device that can rapidly cool or heat carbonated or non-carbonated liquid from room temperature to a desired temperature. The electric on-demand device allows pour-through and pump-through fluid dispensing and temperature control.

20 Claims, 18 Drawing Sheets

(56) References Cited

U.S. PATENT DOCUMENTS

| | | | | |
|---|---|---|---|---|
| 2014/0250919 | A1 | 9/2014 | Obermaier | |
| 2016/0003502 | A1* | 1/2016 | Zelissen | F25B 21/02 136/205 |

* cited by examiner

SYSTEM AND METHOD FOR RAPID FLUID CHILLING AND HEATING FOR CARBONATED AND NON-CARBONATED FLUIDS

BACKGROUND

The invention described herein relates to the rapid chilling, heating, and dispensing of fluids on-demand.

There are numerous known methods to quickly heat fluids, however there are few options to make a fluid cold quickly. Prior attempts at fluid chilling have used phase change materials such as ice, refrigeration based on compressor and evaporator units, or thermoelectric devices cooled with heat sinks and forced air as the cooling mechanism to transfer heat out of a fluid of interest.

Methods used to directly cool beverage containers, including thermoelectric device methods, suffer from heat conduction barriers caused by the fluid container, the low thermal conductivity of the fluid itself, and the interface to the fluid container. The aforementioned cooling methods are slower than desirable for on-demand chilled beverage dispensing due to these thermal transfer barriers and the large amount of heat that must be extracted from the fluid.

Cooling beverages directly in a container prevents loss of carbonation during chilling, but also takes many minutes to hours to cool a beverage from room temperature to serving temperatures. Fluid thermal conductivity issues within a beverage container can be mitigated by vortexing the liquid, but rapid chilling still requires a bath of ice or near freezing liquid to interface with the beverage container. Existing systems use an ice bath or small compressor-based refrigerator to provide the bath. Ice baths require a significant time to generate, and thus are not ideal for on demand fluid chilling.

Methods using metal tubes, coils, or interior flow plates as the fluid interface are not ideal due to the long flow path required to chill a beverage from room temperature to a desired temperature. The long flow path necessitates that a large volume be occupied in any chilling unit and a large amount of materials be used. Additionally, the geometry of such solutions does not lend themselves well to thermoelectric device-based cooling, as the increased volume results in extra material to chill in addition to increased convective losses. Due to these constraints, the heat transfer rate is reduced unless a phase change material such as ice is put in contact with the fluid interface structure. Additionally, non-pressurized pour-through chillers cause carbonation loss in fluids such as beer during chilling.

A direct thermoelectric device based machine for chilling spirituous beverages, in US 20140250919, extracts heat from a fluid through a finned heat sink the fluid is partially contacting. The thermal transfer rate of this machine is limited by the heat dissipation rate into the environment and the thermal geometry imposed on the fluid by the thermal fins. Heat transfer rate limitations to the environment result in inadequate cooling times for on demand standard size beverages such as beer and water. This device does not teach the optimal geometry to contact a fluid for chilling and heating, or decoupling the heat transfer rates of the thermoelectric device and the environment through the use of a heat reservoir. In addition, the machine is not built to handle carbonated beverage cooling.

The Keurig Kold device in US 20160109175 A1 likewise teaches the use of a thermoelectric device coupled to a cooling tank and a heat pipe at an evaporator section, where the condenser portion of the heat pipe is connected to a heat sink and forced air. In addition, the thermoelectric may be used to form an ice to interface an inner container. This device does not teach the optimal geometry to contact a fluid for chilling and heating, or decoupling the heat transfer rates of the thermoelectric device and the environment through the use of a heat reservoir. The thermoelectric device heat transfer rate is thus decreased due to increased hot side temperature on the thermoelectric device and limited heat transfer rate to the environment. In addition, heat transfer through the fluid is many times slower than the optimal geometry. Reduced cooling rates may result in significant startup times of hours to chill the fluid within the inner reservoir. As a result, a limited number of beverages can be served sequentially, impacting usability and average beverage serving speed.

Publication DE202008004284 U1 discloses a flow through water chiller that transfers heat from water flowing throw a finned heat sink within a chamber, with a thermoelectric device pumping heat out of the fluid to a heat pipe system interfacing to heat sinks or cooling towers cooled with forced air. This device does not teach the optimal geometry to contact a fluid for chilling and heating, or decoupling the heat transfer rates of the thermoelectric device and the environment through the use of a heat reservoir. The thermoelectric device heat transfer rate is thus decreased due to increased hot side temperature on the thermoelectric device and limited heat transfer rate to the environment. Heat transfer through the fluid is many times slower than the optimal geometry. In addition, the machine is not built to handle carbonated beverage cooling.

Publication DE4036210 A1 discloses a fluid chiller where an enclosed zigzag flow pattern within a heat exchange body is connected to thermoelectric elements. The thermoelectric elements are also connected to a heat sink. This device teaches a non-optimal geometry to contact a large volume of fluid for chilling. It also does not teach decoupling the heat transfer rates of the thermoelectric device and the environment through the use of a heat reservoir. The thermoelectric device heat transfer rate is thus decreased due to increased hot side temperature on the thermoelectric device and limited heat transfer rate to the environment. In addition, the volume of fluid that can be cooled rapidly is small.

The Quickchill thermoelectric water chiller from Santa Clara University describes a cooling system with a water chamber, thermoelectric modules, and heat sinks that are attached inside chamber. The device described quotes a 20-minute chilling time. This device does not teach the optimal geometry to contact a fluid for chilling or decoupling the heat transfer rates of the thermoelectric device and the environment through the use of a heat reservoir. The thermoelectric device heat transfer rate is thus decreased due to increased hot side temperature on the thermoelectric device and limited heat transfer rate to the environment. In addition, heat transfer through the fluid is many times slower than the optimal geometry.

Utility model G 9300986.0 proposes a bottle holder for a dosing device for spirituous beverages that is connected to Peltier elements to thermoelectrically cool the bottles fastened to the bottle holder. The cooling of the bottle contents is effected by thermal contact of the bottle with a cooled surface of the bottle holder. As bottles are generally poor heat conductors and, moreover, the bottle holder contacts only a fraction of the bottle surface, the cooling effect of this device is limited.

Laid-Open Print DE 4036210 A1 also describes a continuous flow cooling realized by means of Peltier elements, wherein, in contrast to DE 202008004284 U1, the beverage liquid does not pass through plural parallel flow channels, but through a single zigzag flow channel. In this device, the serving temperature is adjusted by controlling the through flow velocity. In order to avoid icing, cooling down to the freezing point or below is prevented by a control using a temperature sensor. This device does not teach the optimal geometry to contact a fluid for chilling or decoupling the heat transfer rates of the thermoelectric device and the environment through the use of a heat reservoir. The thermoelectric device heat transfer rate is thus decreased due to increased hot side temperature on the thermoelectric device and limited heat transfer rate to the environment. Heat transfer through the fluid is many times slower than the optimal geometry. In addition, the machine is not built to handle carbonated beverage cooling.

Laid-Open Print DE 102007028329 A1 also proposes a continuous flow beverage cooler, wherein the heat exchanger has only a single flow channel for the beverage liquid to pass through. In order to obtain a large heat exchange area with relative small dimensions, the flow channel is configured helically. The cooling of the heat exchanger may be effected, among others, by use of Peltier elements. The geometry of this device does not lend itself well to thermoelectric device based cooling as the increased volume results in extra material to chill in addition to increased convective losses. Due to these constraints, the heat transfer rate is reduced unless a phase change material such as ice is put in contact with the fluid interface structure.

Publication U.S. Pat. No. 6,119,464 describes a tank containing water that serves as a coolant and a coiled beverage duct through which beverage flows. An electronic cooling element serving as a cooling device is fitted to one of the walls of the tank. The electronic cooling element cools the water in the tank by absorbing heat by means of the Peltier effect. The absorbed heat is released by a heat-release fin and a fan. Beer or other beverage fed under pressure into the coiled beverage duct in the tank through an inlet is cooled by the water and poured into a mug or other container through an outlet by opening a cock. The geometry of this device does not lend itself well to thermoelectric device based cooling as the increased volume results in extra material to chill in addition to increased convective losses. Due to these constraints, the heat transfer rate is reduced, increasing chilling time and power consumption.

SUMMARY OF THE INVENTION

Aspects of the invention relate to systems for cooling and heating a liquid. The liquid may be carbonated, such as beer, or may be non-carbonated such as water. Additional aspects of the invention relate to dispensing beverages. The terms "liquid", "fluid", "beer", and "beverage" may be used interchangeably throughout this disclosure.

In one embodiment, a beverage dispensing machine includes a primary cooling and heating system, a secondary cooling and heating system, a fluid fill and control system, a carbonation system, and a self-cleaning and fluid supply system. The primary cooling and heating system may include a fluid container, internal fluid heat sink, thermoelectric device, and a fluid-cooling interface. The secondary cooling system may include a fluid cooling interface, a radiator or heat sink, a fan, a pump, and a coolant reservoir to store heat. The carbonation control system may include one or more valves which may be electrically controllable and a gas source. The fluid fill and control system may include a funnel positioned to transition fluid through hydrostatic pressure, laminar flow tube transitions to the fluid container, a flow suppressor, and one or more valves that may be electrically actuated configured as inlets and outlets. The fluid fill and control system may also include an inlet for connection to a pressurized fluid. The self-cleaning system may include a fluid reservoir, a waste reservoir, a pump, and one or more valves.

In one embodiment, one or more thermoelectric devices pump heat from or to the fluid through the internal fluid heat sink or heat sinks. The internal fluid heat sink or heat sinks are in contact with a thermal interface material that is also in contact with the one or more thermoelectric devices. One or more coolant circulating blocks contact the thermoelectric device or devices, though a second thermal interface material, transferring heat to or from the coolant. A pump cycles the coolant through a forced-air radiator and into a coolant reservoir. The coolant reservoir stores or provides heat, causing a slow temperature change in the coolant, allowing the thermoelectric device or devices to operate at near the maximum heat transfer rate of the thermoelectric device or devices. The heat in the coolant is transferred into the radiator and out to the environment through forced air delivered by a fan, at a rate decoupled from the primary cooling and heating system thermal transfer rate in chilling mode of operation. In a heating mode of operation, waste heat from the one or more thermoelectric devices, in addition to heat extracted from the coolant, is supplied to the fluid. Heat is extracted from the environment through the radiator to warm the coolant at a rate decoupled from the primary cooling and heating system heat transfer rate. A valve opens an outlet to dispense the beverage. The heat transport direction of the system may be reversed by reversing the polarity of the electricity supplied to the thermoelectric devices, heating the fluid instead of cooling it for hot beverages.

In some embodiments, the internal heat transfer interface may consist of a plurality of fluid columns less than 8 mm thick and more than 0.5 mm thick, but optimally between 2 mm to 3 mm thick. Fluid column width may be implemented by heat sink fin channels or pins that are spaced 8 mm apart or less and more than 0.5 mm, but optimally 2 mm to 3 mm. Fin or pin depth is between 3 mm and 20 mm for fluid temperature uniformity. Fin or pin width is optimally between 0.5 mm and 3 mm for optimum heat transfer rate and temperature uniformity. Fin or pin geometry optimizes heat transfer rates of the fluid and, in addition, provides temperature uniformity while chilling or heating the fluid.

In another embodiment, the internal heat transfer interface may consist of a plurality of fluid columns less than 20 mm thick and more than 0.1 mm thick, but optimally between 2 mm to 3 mm thick. Fluid column width may be implemented by heat sink fin channels or pins that are spaced 20 mm apart or less and more than 0.1 mm, but optimally 2 mm to 3 mm. Fin or pin depth is between 1 mm and 50 mm for fluid temperature uniformity In some embodiments, a beverage inlet valve, gas outlet valve, and beverage outlet valve, which may be electrically controllable, are configured to allow filling from a funnel through hydrostatic pressure. The fluid fills the fluid container and rises through a flow suppressor to minimize foaming in carbonated beverages. The valves may then be closed to allow the beverage to be sealed for cooling. A gas supply may be interfaced through a gas inlet valve, which may be electrically controllable, to provide carbon dioxide or other gas for dissolution into the fluid during chilling, or to maintain a carbonation state.

In some embodiments, a pressurized fluid may be connected to the fluid or beverage inlet rather than a funnel. The fluid or beverage inlet may be at the top or bottom of the fluid container. The system may be configured as described above or for flow through operation.

In some embodiments, a fluid inlet valve may be configured to accept a fluid or cleaning solution from a fluid reservoir. A pump may deliver the fluid or cleaning solution to the fluid inlet valve and/or the funnel. The waste outlet valve, which may be a three-way valve, may be configured to release the cleaning solution or fluid to a waste reservoir after flowing through the system. Fluid supplied to the fluid inlet valve may also be used to generate hot water for beverages and dispensed from the beverage outlet valve.

In one embodiment, a room temperature carbonated or non-carbonated beverage of between 100 ml and 1000 ml, but nominally 350 ml to 500 ml may be chilled in less than 120 seconds by approximately 20 C, but nominally less than 60 seconds. Carbonation may be increased or decreased during chilling to provide a desired taste profile.

In an embodiment, the invention comprises a fluid chilling, heating, and dispensing machine, comprising: a fluid container; a fluid inlet coupled to the fluid container and configured to receive a fluid, and further configured to direct the fluid into the fluid container; a primary cooling and heating system coupled to the fluid container, and configured to selectively remove heat from the fluid and supply heat to the fluid, wherein a primary heat transfer conducted by the primary cooling and heating system occurs at a first heat transfer rate; and a secondary cooling and heating system coupled to the primary cooling and heating system, and configured to selectively remove heat from the primary cooling and heating system and supply heat to the primary cooling and heating system, wherein a secondary heat transfer to an external environment conducted by the secondary cooling and heating system occurs at a second heat transfer rate different from the first heat transfer rate.

In another embodiment, the invention comprises a beverage chilling and dispensing machine, comprising: a fluid container; a beverage inlet coupled to the fluid container and configured to receive a beverage, and further configured to direct the beverage into the fluid container; a primary cooling system coupled to the fluid container, and configured to remove heat from the beverage at a first heat transfer rate; a secondary cooling system coupled to the primary cooling system, and configured to remove heat from the primary cooling system, and expel the heat to the environment at a second heat transfer rate; and a gas supply system coupled to the fluid container and configured to supply carbonation or nitrogen to the beverage.

In yet another embodiment, the invention comprises a fluid chilling and dispensing system, comprising: a fluid container configured to receive a first fluid from a remote container via a fluid supply line; a primary cooling system coupled to the fluid container, and configured to remove heat from the first fluid; and a secondary cooling system coupled to the primary cooling system, and configured to remove heat from the primary cooling system.

These and other aspects of the invention will be apparent from the following description and claims.

BRIEF DESCRIPTION OF THE DRAWINGS

Aspects of the invention are described with reference to the following drawings in which like numerals reference like elements, and wherein.

DETAILED DESCRIPTION

Figure 1:
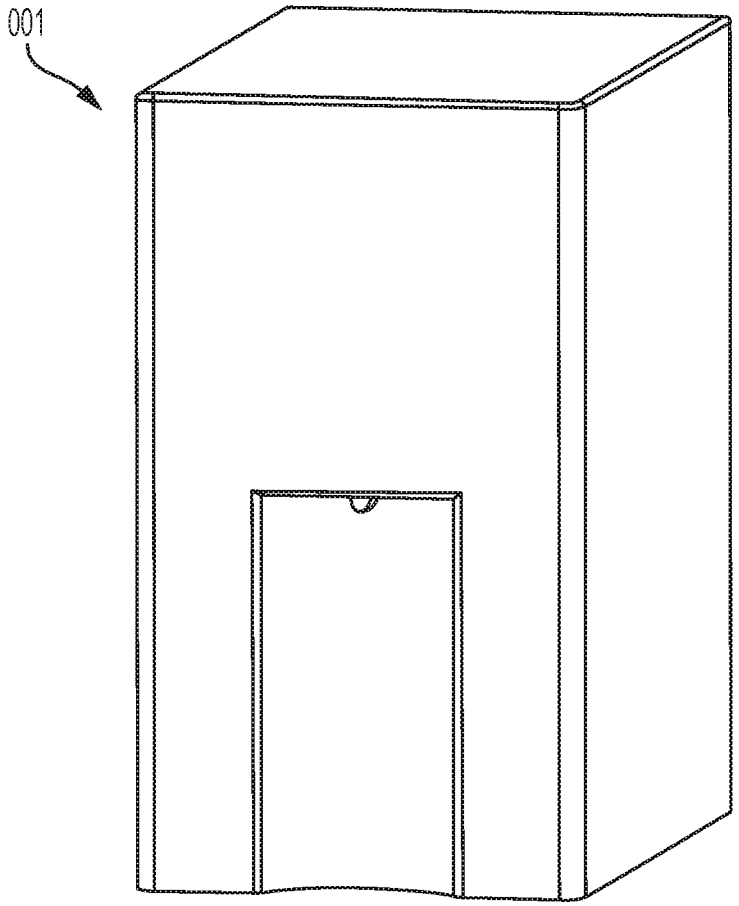
FIG. 1 shows a perspective view of an illustrative embodiment of a rapid fluid chilling, heating, and dispensing machine.

It should be understood that aspects of the invention are described herein with reference to the figures, which show illustrative embodiments. The illustrative embodiments herein are not necessarily intended to show all embodiments in accordance with the invention, but rather are used to describe a few illustrative embodiments. Thus, aspects of the invention are not intended to be construed narrowly in view of the illustrative embodiments. In addition, it should be understood that aspects of the invention maybe used alone or in any suitable combination with other aspects of the invention.

In accordance with one aspect of the invention, a rapid fluid chilling, heating, and dispensing system 001 may have carbonated or non-carbonated fluid such as beer, soda, wine, liquor, water, oil, tonic, or other fluids, poured into the system from an opened fluid container. In addition, fluid may be fed into the system through a pressurized tube. The rapid fluid chiller, heater, and dispenser machine 001 may accept input from a user through a touch screen display or other interface (not shown) to configure the machine for pressurized or non-pressurized operation, desired temperature, and carbonation level through a control circuit. The rapid chilling, heating, and dispensing machine 001 heats or chills the fluid and dispenses it according to the user input. Desired temperature or other settings may also be configured as presets, favorites. In addition, multiple users, such as in a household or office environment, may each have their own preset or favorite settings which can be automatically initiated upon a specific user approaching, touching, or interacting with the system.

In accordance with one aspect of the invention, the user may input commands into the machine using a remote interface, such as via a mobile device, smartphone, tablet, portable computing device, point-of-sale system, or building automation control system.

In another embodiment of the invention, a mobile device application, such as a software "app" available via the Apple App Store® and Google Play®, can be used to receive commands from the user and transmit the commands to the machine via a wireless or wired interface. The machine may include a transceiver used to send and receive commands and data from a remote device. The transceiver can include, for example, a hard-wire Ethernet port, a wireless transmitter/receiver, or a short-range radio module. The machine and the user device can be configured for bi-directional communication, thereby allowing the machine to transmit data to the user device. Such data can include, for example, a temperature, a cooling or heating status, a timer, a completion indication, an error indication, a carbonation level, and a service reminder or notice.

In yet another embodiment of the invention, the interface can receive a gesture input or a voice command. The machine may have built-in safety mechanisms to prevent unauthorized or accidental use, such as a two-factor activation switch, an image sensing means used to validate an age shown on the user's identification, a fingerprint reader, an iris scanner, an alphanumeric password, or a mechanical key switch.

Figure 2:
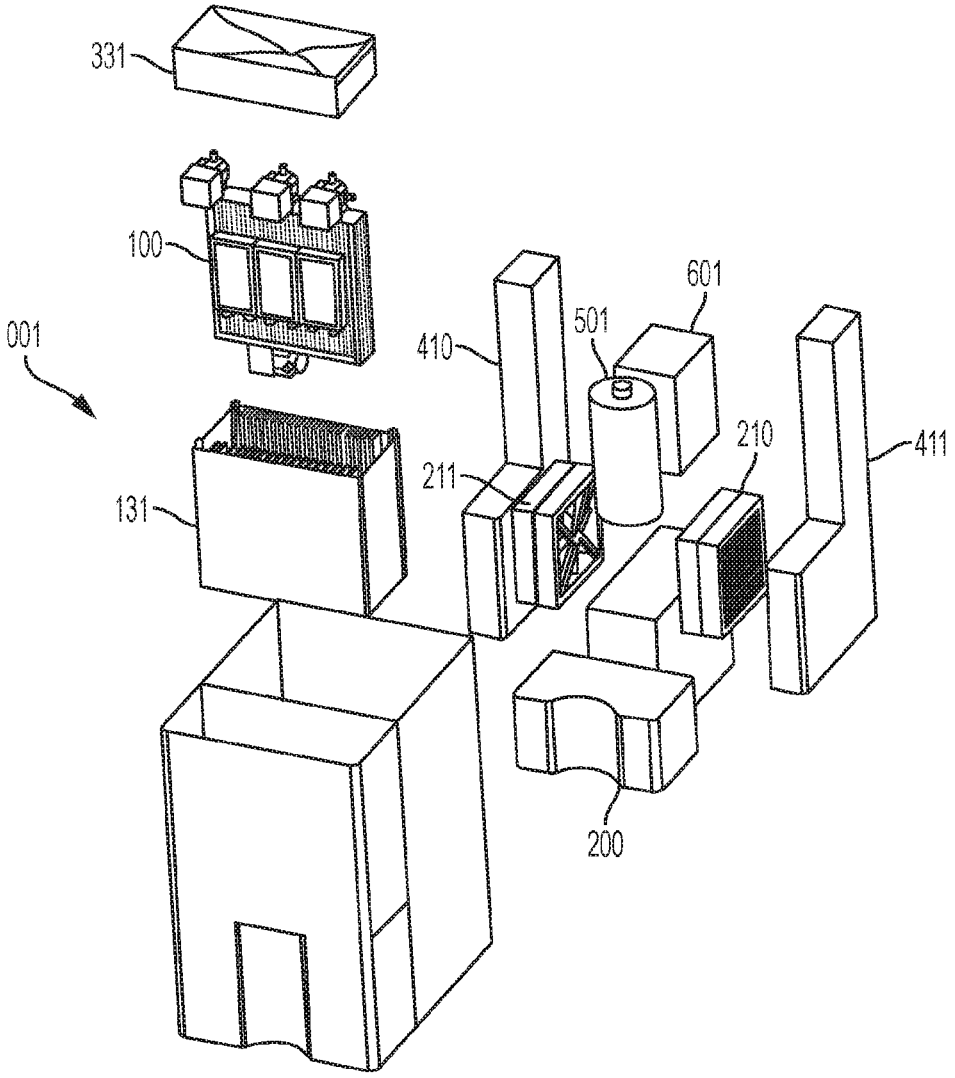
FIG. 2 shows an exploded view of the rapid fluid chilling, heating, and dispensing machine from FIG. 1.

In one illustrative embodiment of the invention, the rapid chilling, heating, and dispensing system 001 may include a primary cooling and heating system 100, a secondary cooling and heating system 200, a fluid fill and control system, a carbonation system, and a self-cleaning and fluid supply system. FIG. 1 shows a perspective view of a rapid chilling, heating, and dispensing machine 001 in an illustrative embodiment. FIG. 2 shows an exploded view of a rapid chilling, heating, and dispensing machine 001 containing these systems. The primary cooling and heating system 100 removes or supplies heat directly to the fluid of interest. The secondary cooling and heating system 200 removes or supplies heat to the primary cooling and heating system 100. The fluid fill and control system guides carbonated or non-carbonated fluid into the primary cooling and heating system 100 with minimum foaming for fluids such as beer. The carbonation system seals or reseals carbonated fluids and may increase or maintain carbonation of the fluid according to user input. The self-cleaning and fluid supply system rinse the primary cooling and heating system 100 and fluid fill and control system, in addition to supplying water or other fluids for heated fluid dispensing applications.

Figure 3:
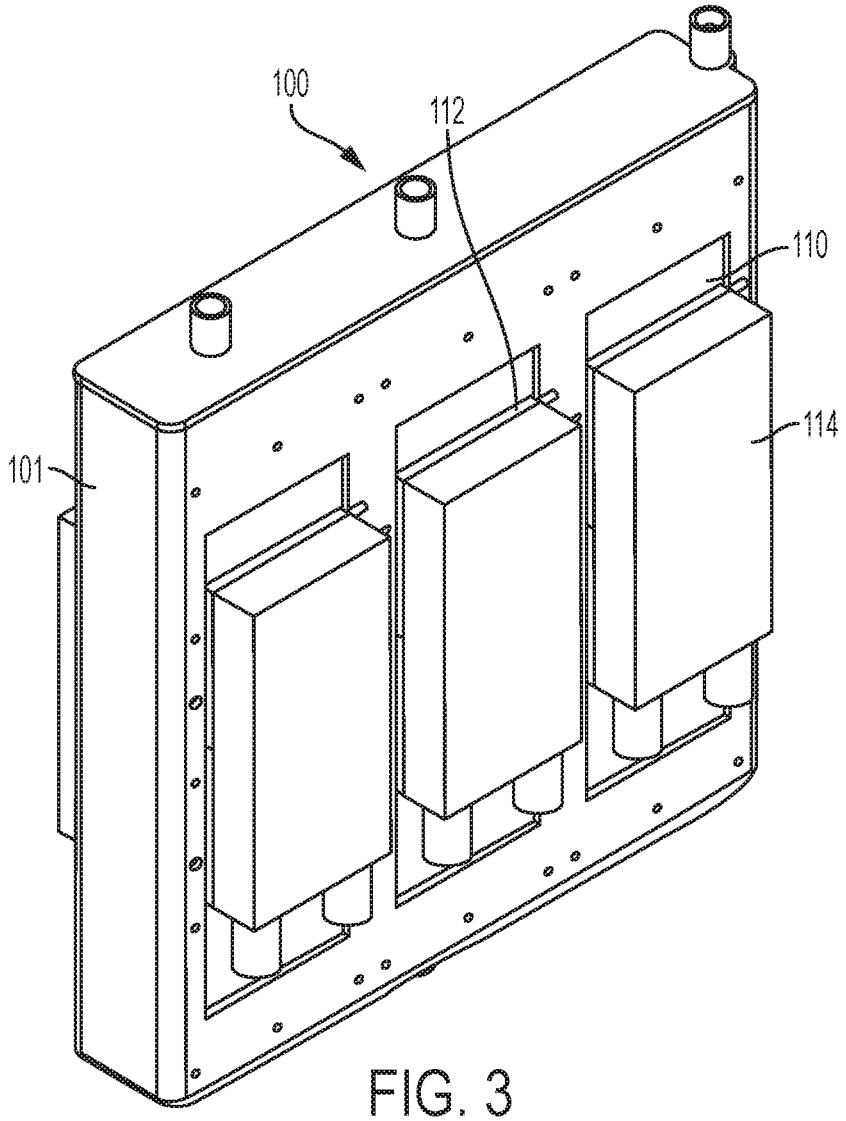
FIG. 3 shows a perspective view of an illustrative embodiment of the basic components of the primary cooling and heating system of a rapid fluid chilling, heating, and dispensing machine.
Figure 4:
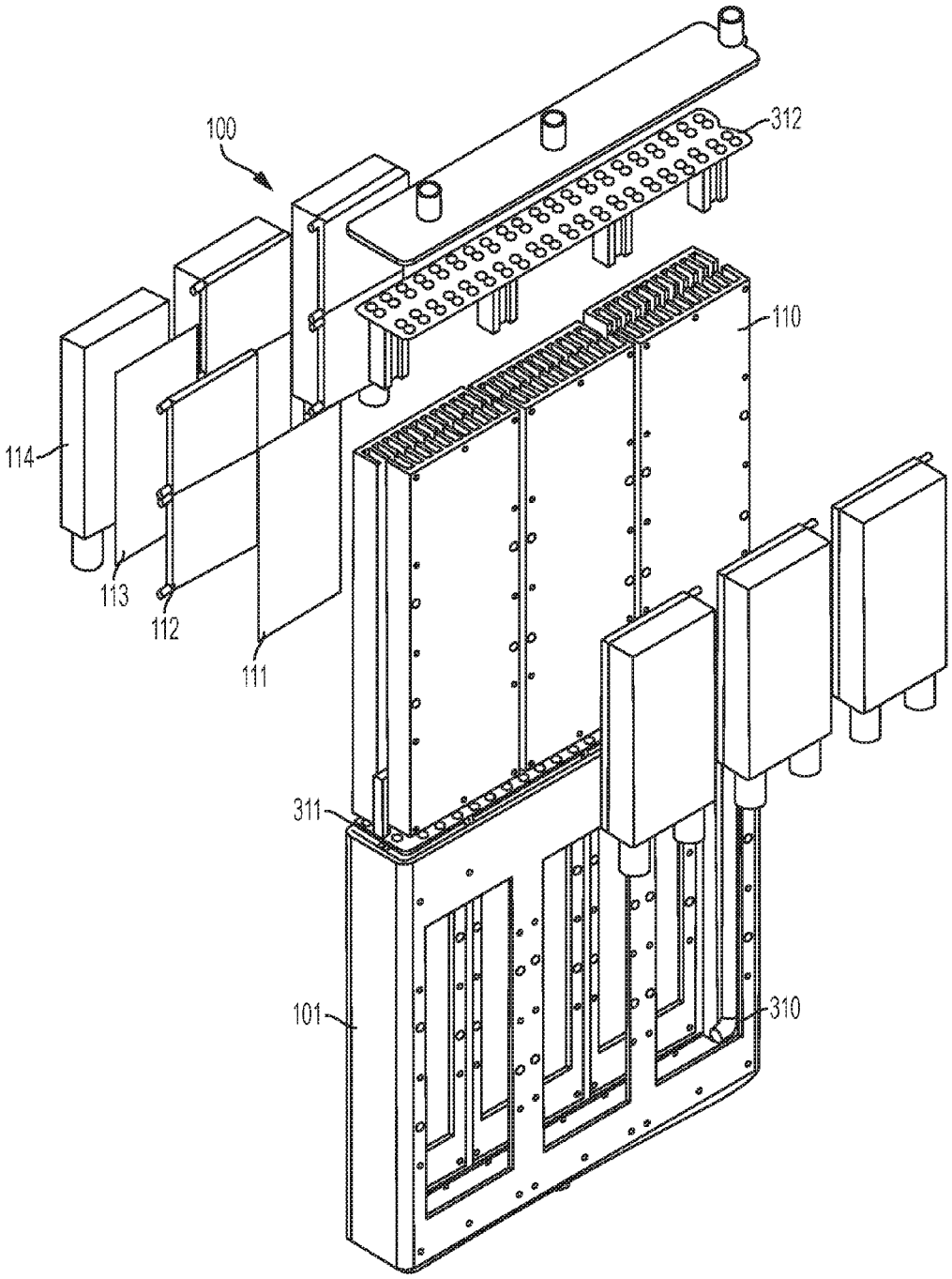
FIG. 4 shows an exploded view of the basic components of the primary cooling and heating system of the rapid fluid chilling, heating, and dispensing machine from FIG. 3.

In accordance with one aspect of the invention, the primary cooling and heating system 100 consists of at least one fluid container 101, one or more interior fluid heat sinks 110 positioned on at least one wall of the fluid container 101, but preferably on two opposite walls, one or more thermoelectric devices 112, one or more coolant chilled blocks 114, a first thermal interface material 111, a second thermal interface material 113, and in some configurations, a fluid container insulating shell 121. FIG. 3 and FIG. 4 show an illustrative embodiment of the primary cooling and heating system 100 from a perspective view and an exploded view, where the interior fluid heat sinks or sinks 110 are connected directly through a first thermal interface material 111 to one or more thermoelectric devices 112. The interior fluid heat sink or sinks 110 are sealed into the fluid container 101 though a gasket, sealant, foam, rubber, silicone, epoxy, resin, or adhesive. The thermoelectric device or devices 112 are connected through a second thermal interface material 113 on the opposite face of the thermoelectric device or devices 112 to one or more coolant circulating blocks 114. The assembly may be held together through compressive pressure, a thermal adhesive, or mechanical fixtures, such as screws or bolts. The compressive pressure may be provided by a compression shell 131, screws, or other method. The first thermal interface 111 material may be a thermally conductive grease, adhesive, or elastomer. The second thermal interface 113 material may be a thermally conductive grease, adhesive, or elastomer. The coolant circulating block or blocks 114 may be any suitable metal, alloy, or a combination of metal and plastics.

Figure 5:
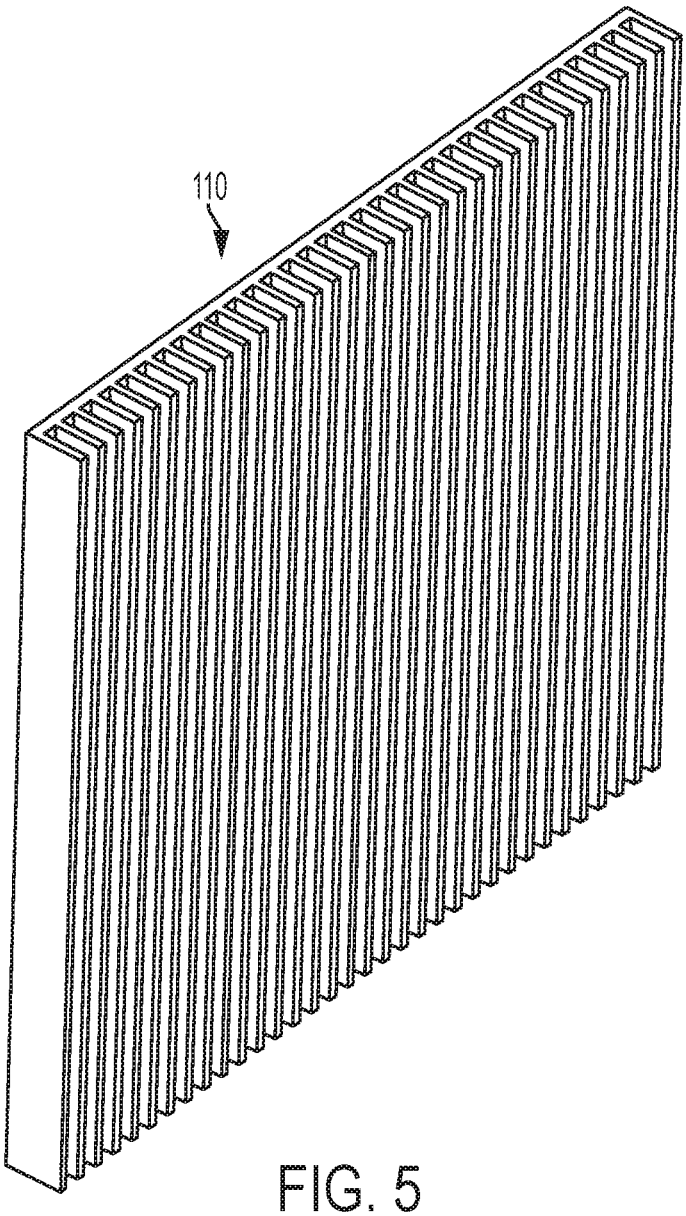
FIG. 5 shows a perspective view of an illustrative fin heat sink within the primary cooling and heating system.

In one aspect of the invention, the primary cooling and heating system 100 interior fluid heat sink or sinks 110 may be a fin heat sink structure, an illustrative embodiment of which is shown in FIG. 5. The interior fluid heat sinks or sinks 110 are ideally composed of a metal such as copper, aluminum, gold, silver, brass, nickel, or steel, but may be another suitable metal or alloy with equivalent properties. The interior fluid heat sink or sinks 110 may also be composed of a high thermal conductivity polymer with thermal conductivity of 20 W/m-K or greater. The interior fluid heat sink or sinks 110 may be a single heat sink or may be split into several units, each with a plurality of fins that extend out from the base of the heat sink between 3 mm and 20 mm, and with fin to fin spacing of 1 mm to 8 mm, but optimally 2 mm to 3 mm, and heat sink fin thickness between 0.5 mm to 3 mm. The interior fluid heat sink or sinks 110 may be fabricated through extrusion, molding, casting, or other appropriate methods.

Figure 6:
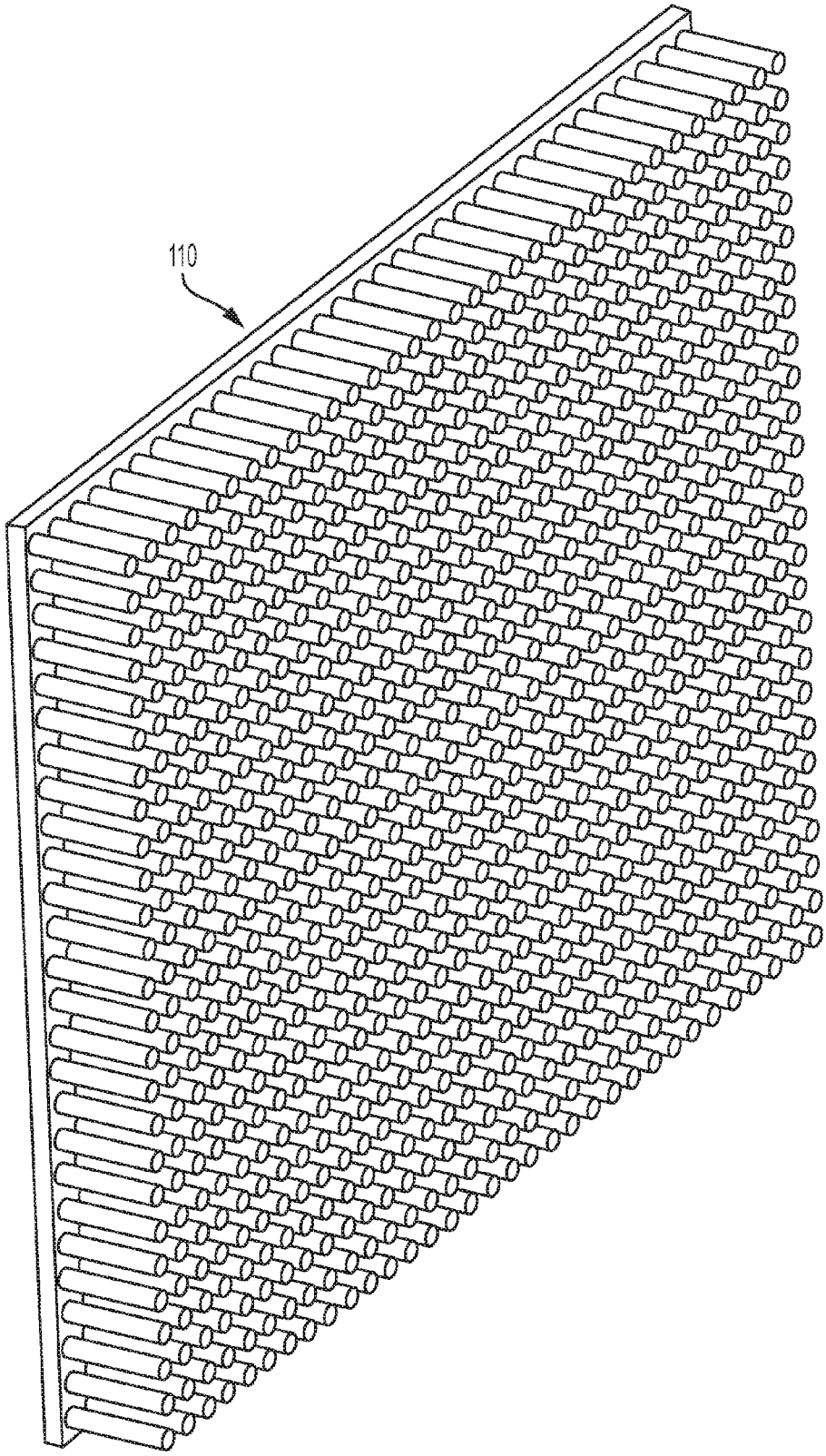
FIG. 6 shows a perspective view of a second illustrative pin heat sink within the primary cooling and heating system.

In one aspect of the invention, the primary cooling and heating system 100 interior fluid heat sink or sinks 110 may be a pin heat sink structure, an illustrative embodiment of which is shown in FIG. 6. The interior fluid heat sink or sinks 110 are ideally composed of a metal such as copper, aluminum, gold, silver, brass, nickel, or steel, but may be another suitable metal or alloy with equivalent properties. The interior fluid heat sink or sinks 110 may also be composed of a high thermal conductivity polymer with thermal conductivity of 20 W/m-K or greater. The interior fluid heat sinks 110 may be a single heat sink or may be split into several units, each with a plurality of pins that extend out from the base of the heat sink between 3 mm and 20 mm, and with pin to pin spacing of 1 mm to 8 mm, but optimally 2 mm to 3 mm, and heat sink pin thickness between 0.5 mm to 3 mm. The interior fluid heat sink or sinks 110 may be fabricated through extrusion, molding, casting, or other appropriate methods.

Figure 7:
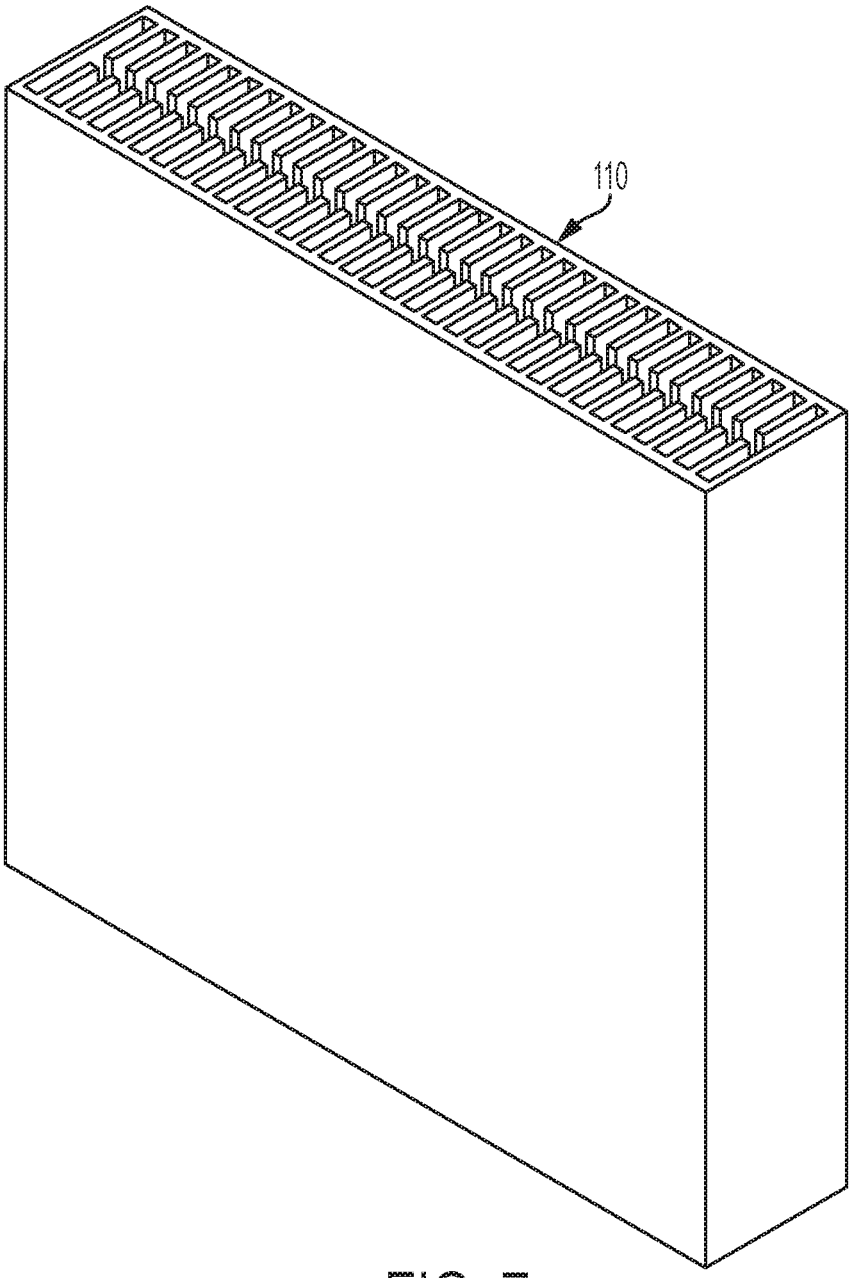
FIG. 7 shows a perspective view of a third illustrative fin or pin enclosed heat sink within the primary cooling and heating system.

In one aspect of the invention, the primary cooling and heating system 100 interior fluid heat sink or sinks 110 is a fin or pin heat sink structure, an illustrative embodiment of which is shown in FIG. 7, where the outer edges of the interior fluid heat sink 110 forms a closed loop for the length of the heat sink, providing a liquid flow path. The interior fluid heat sink or sinks 110 are ideally composed of a metal such as copper, aluminum, gold, silver, brass, nickel, or steel, but may be another suitable metal or a suitable alloy with equivalent properties. The interior fluid heat sink or sinks 110 may also be composed of a high thermal conductivity polymer with thermal conductivity of 20 W/m-K or greater. The interior fluid heat sink or sinks 110 has a plurality of fins or pins that extend out from the base of the heat sink between 3 mm and 20 mm, and with fin to fin or pin to pin spacing of 1 mm to 8 mm, but optimally 2 mm to 3 mm, and heat sink fin or pin thickness between 0.5 mm to 3 mm. The interior fluid heat sink or sinks 110 may be fabricated through molding, casting, or other appropriate methods.

The rate of chilling or heating a fluid is ultimately limited by the bulk thermal properties and geometric arrangement of the fluid itself, rather than container properties. In addition, insulating containers will further slow the heat transfer process. As an illustrative example, the container of a canned beverage has little effect on the thermal transfer rate due to the high thermal conductivity of the metal container, which may be 250 times or more the thermal conductivity of the water-based beverage inside the container. In addition, the water-based beverage has a specific heat four times or more that of the metal container. The geometric arrangement of fluid inside a canned beverage container forces heat transport incrementally through low thermal conductivity fluid, creating a very low heat transfer rate limited by fluid bulk thermal properties. However, the heat transfer rate through a fluid such as water can be optimized, increasing many times over, in specific geometries, without fluid vortexing.

In the rapid chilling, heating, and dispensing system 001 described herein, the heat transfer rate is maximized through the fluid by limiting the thermal path length through the fluid while also minimizing flow and retention issues caused by capillary effects. The heat transfer rate of the specific geometric arrangements of the interior fluid heat sink or sinks 110 embodiments described herein are 20 times that of a canned beverage at 3 mm fin or pin spacing, and 33 times that of a canned beverage at 2 mm fin or pin spacing. The optimum geometries taught herein are at least 7 times faster than that of heat sinks of 10 mm spacing and have the minimum total heat capacity for a given material. In addition, the optimum structures herein produce a nearly uniform temperature distribution across the fluid during chilling.

Several factors contribute to the time necessary to change the temperature of the fluid of interest, requiring an optimum balance. One factor is the total energy storage of the fluid and components in thermal contact with the fluid, which is mostly the sum of the fluid, interior fluid heat sinks or sinks 110, and the fluid container 101 heat capacity at their fixed volume. The total time to chill or heat fluid due to stored heat potential, without losses, is determined by the thermoelectric device or devices heat transfer rate and the total energy stored in the system for the desired temperature change. This factor sets a limitation on the interior fluid heat sink or sinks 110 in terms of fin or pin width and depth from the base.

A second factor is the change in the fluid heat transfer rate due to geometry, which sets limitations on the fluid channel width. A fluid thermal path length of 4 mm corresponds to thermal response times of nearly two minutes to change 18 C from room temperature, reducing to under ten seconds for thermal path lengths of 1 mm. The thermal path length in the interior fluid heat sink or sinks 110 is half the pin or fin spacing. Fin or pin width must be limited to between 0.5 mm and 3 mm with fin or pin depth restricted to between 3 mm to 20 mm, to allow the stored heat potential of the system for a 20 C change be transferred in 70 seconds or less.

The interior fluid heat sink or sinks 110 protrusions width and depth from the base, in addition, heavily effects uniformity of the heat transfer rate, and thus temperature distribution within the channels. For uniform temperature, over a 20 C change, it is preferable to have approximately an effective thermal conductivity, considering dimensions, of ten times that of the fluid channel for the end of the fin or pin to the base of the interior fluid heat sink 110, although four times or less may be acceptable for some applications. The width and length of the fins or pins are further restricted within the aforementioned range based on heat sink material bulk thermal conductivity.

The fluid channel size for the interior fluid heat sink or sinks 110 of the rapid fluid chilling, heating, and dispensing system 001 is optimally limited from being smaller than between 2 mm to 3 mm due to several additional physical limitations. Capillary effects begin to interfere with fluid drainage when fin or pin spacing of the interior fluid heat sink or sinks 110 goes below around 2 mm to 3 mm based on material choice and surface coatings for open atmosphere systems. In addition, as fluid channel spacing becomes tighter this leads to increased friction for pumped systems or open fill systems resulting in increased foaming for carbonated beverages.

Figure 8:
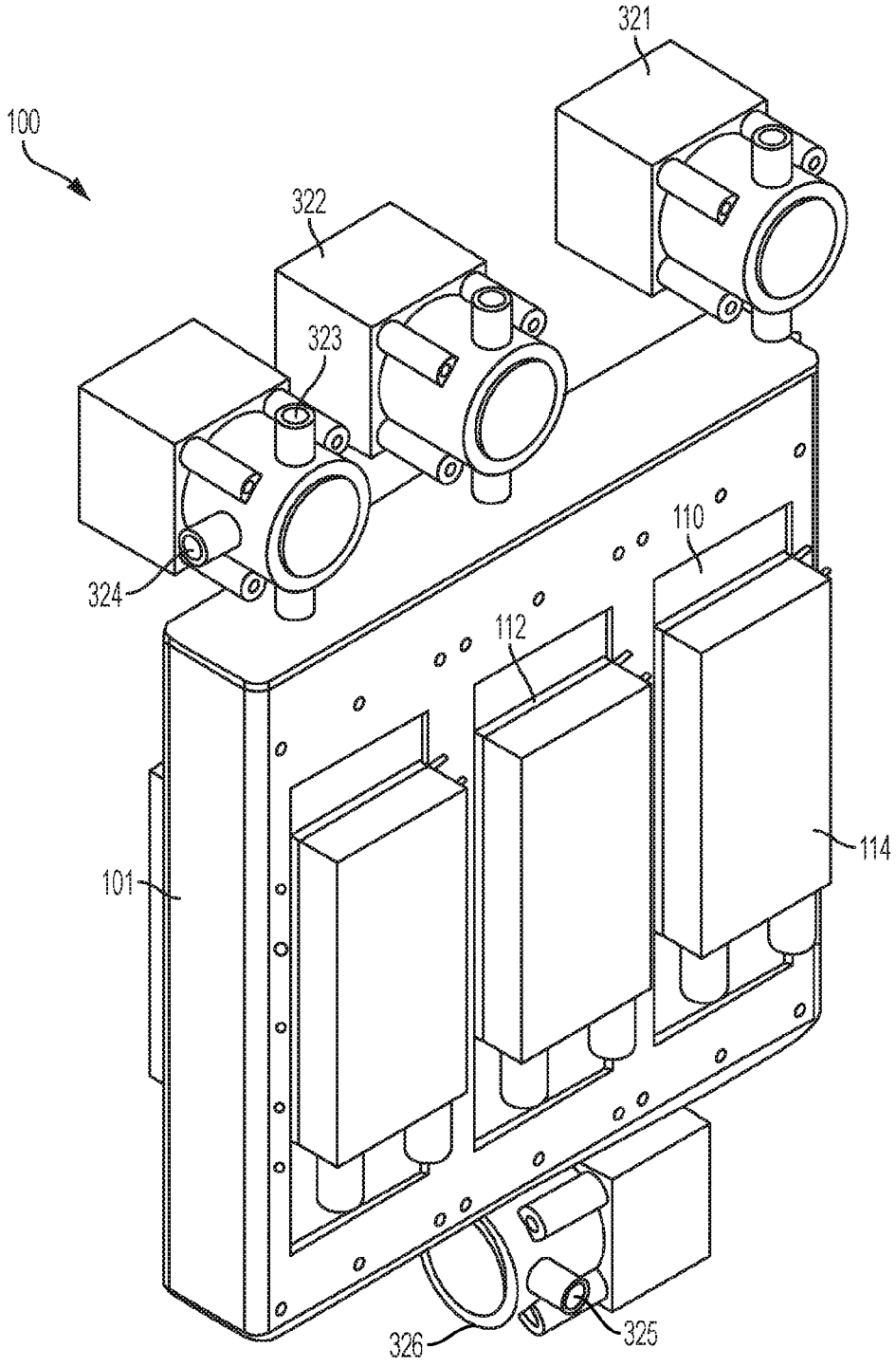
FIG. 8 shows a perspective view of a first illustrative embodiment of the primary cooling and heating system of a rapid fluid chilling, heating, and dispensing machine.
Figure 9:
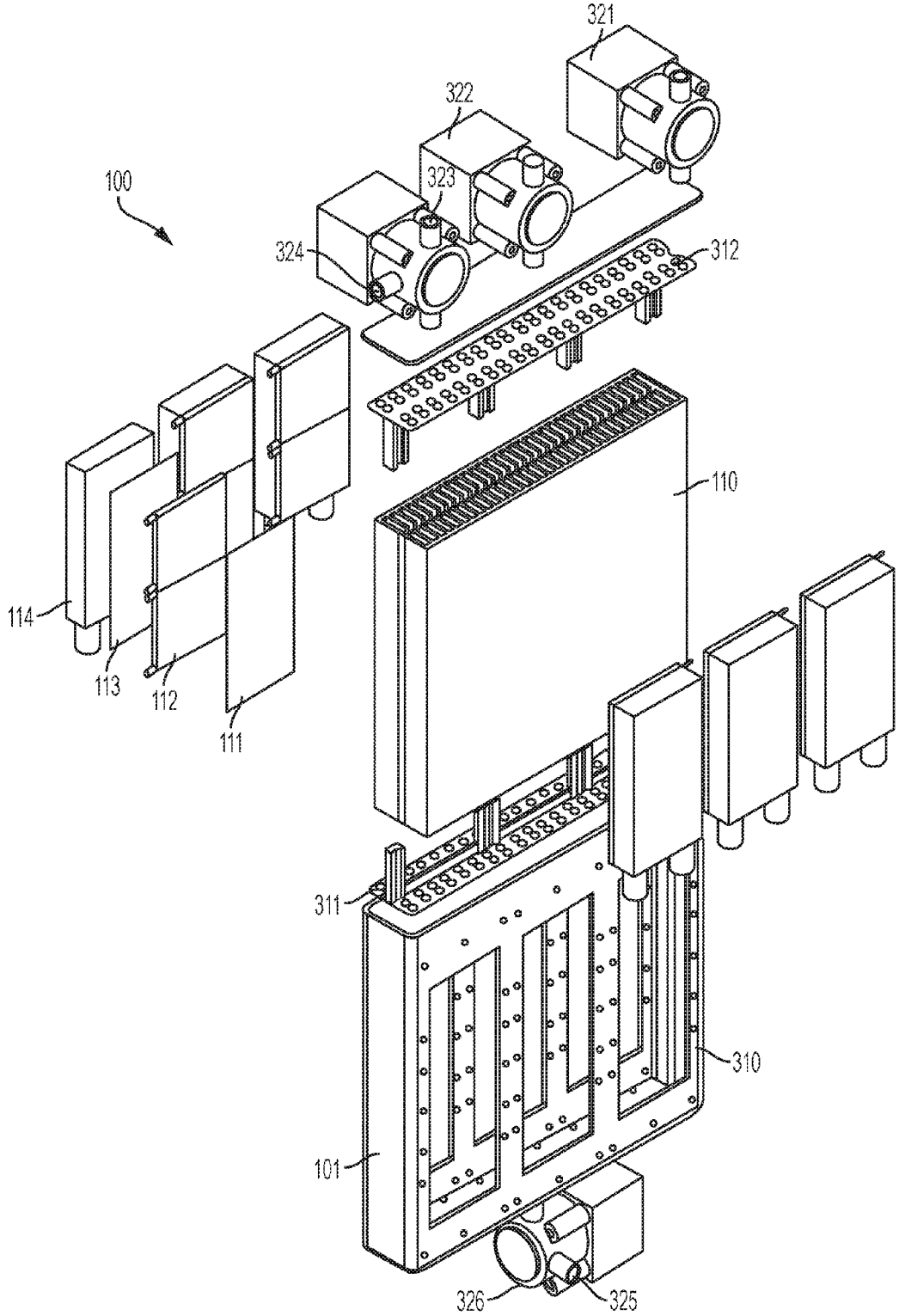
FIG. 9 shows an exploded view of the primary cooling and heating system of the rapid fluid chilling, heating, and dispensing machine from FIG. 8.

In one aspect of the invention, the fluid container 101 in the primary cooling and heating system 100 is a plastic container with thermal conductivity of less than 1 W/m-K that may have a fluid inlet valve 322, a beverage inlet valve 321, a gas inlet valve 323, a gas outlet valve 324, a beverage outlet valve 325, and a waste outlet valve 326, an illustrative embodiment of which is shown in FIG. 8 from a perspective view, and FIG. 9 from an exploded view. The beverage inlet 321 may accept fluids other than beverages. The gas inlet 323 and gas outlet 324 may be combined in a three-way valve. The beverage outlet 325 and waste outlet 326 may be combined in a three-way valve. Each valve may be electrically actuated through a solenoid or other actuation device. The fluid container 101 may have one or more windows that allow direct access to the interior fluid heat sink or sinks 110. The fluid container 101 is sealed to the interior fluid heat sink or sinks 110 through a gasket, sealant, or adhesive, thereby providing an integrated, one-piece or unitary construction of the fluid container 101 and the interior fluid heat sink or sinks 110. The interior fluid heat sinks or sinks 110 are connected directly through a first thermal interface material 111 to one or more thermoelectric devices 112. The thermoelectric device or devices 112 are connected through a second thermal interface material 113 on the opposite face of the thermoelectric device or devices 112 to one or more coolant circulating blocks 114. The assembly may be held together through compressive pressure, mechanical fixtures, or a thermal adhesive.

Figure 10:
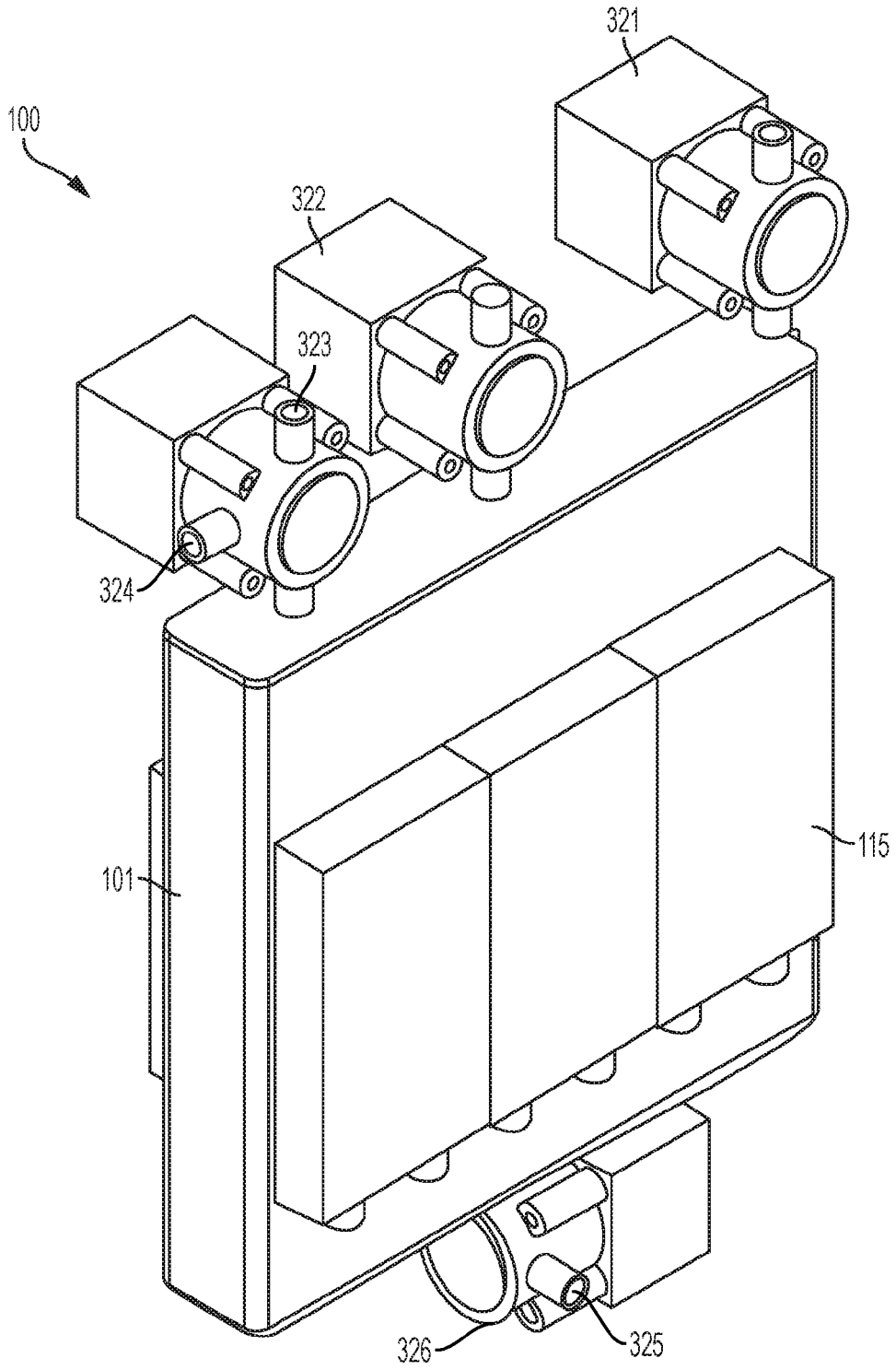
FIG. 10 shows a perspective view of a second illustrative embodiment of the primary cooling and heating system of a rapid fluid chilling, heating, and dispensing machine.
Figure 11:
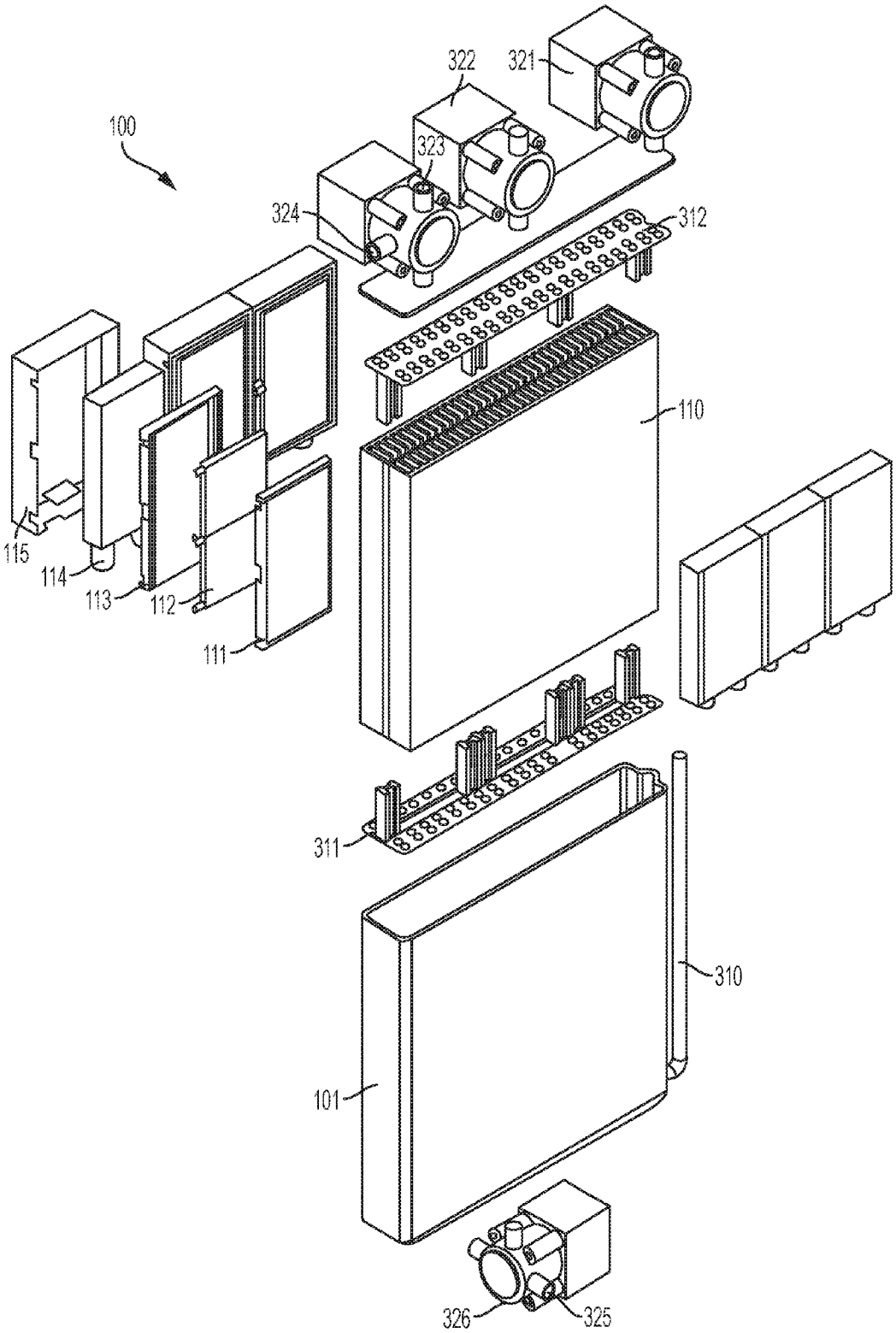
FIG. 11 shows an exploded view of the primary cooling and heating system of the rapid fluid chilling, heating, and dispensing machine from FIG. 10.

In one aspect of the invention, the fluid container 101 in the primary cooling and heating system 100 is a thermally conductive plastic container with thermal conductivity between 2 W/m-K and 50 W/m-K that may have a fluid inlet valve 322, a beverage inlet valve 321, a gas inlet valve 323, a gas outlet valve 324, a beverage outlet valve 325, and a waste outlet valve 326, an illustrative embodiment of which is shown in FIG. 10 from a perspective view, and FIG. 11 from an exploded view. The beverage inlet 321 may accept fluids other than beverages. The gas inlet 323 and gas outlet 324 may be combined in a three-way valve. The beverage outlet 325 and waste outlet 326 may be combined in a three-way valve. Each valve may be electrically actuated through a solenoid or other actuation device. The fluid container 101 has no windows and may be interfaced to the interior fluid heat sink or sinks 110 through over molding, compression directly against the interior fluid heat sink 110, or with an intermediate thermal elastomer through compression. The fluid container 101 is connected directly through a first thermal interface material 111 to one or more thermoelectric devices 112. The thermoelectric device or devices 112 are connected through a second thermal interface material 113 on the opposite face of the thermoelectric device or devices 112 to one or more coolant circulating blocks 114. The assembly may be held together through compressive pressure or thermal adhesive.

Figure 12:
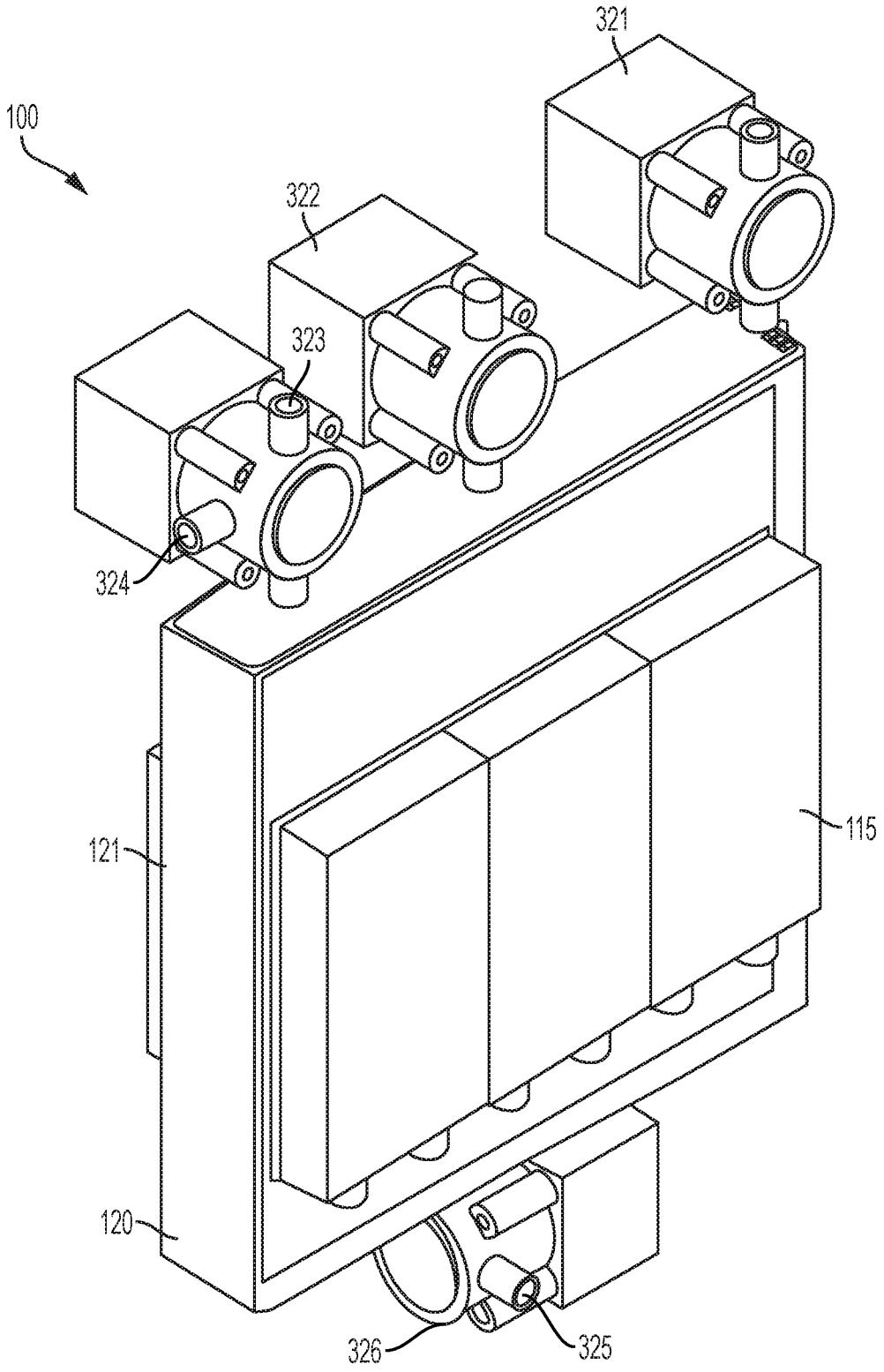
FIG. 12 shows a perspective view of a third illustrative embodiment of the primary cooling and heating system of a rapid fluid chilling, heating, and dispensing machine.
Figure 13:
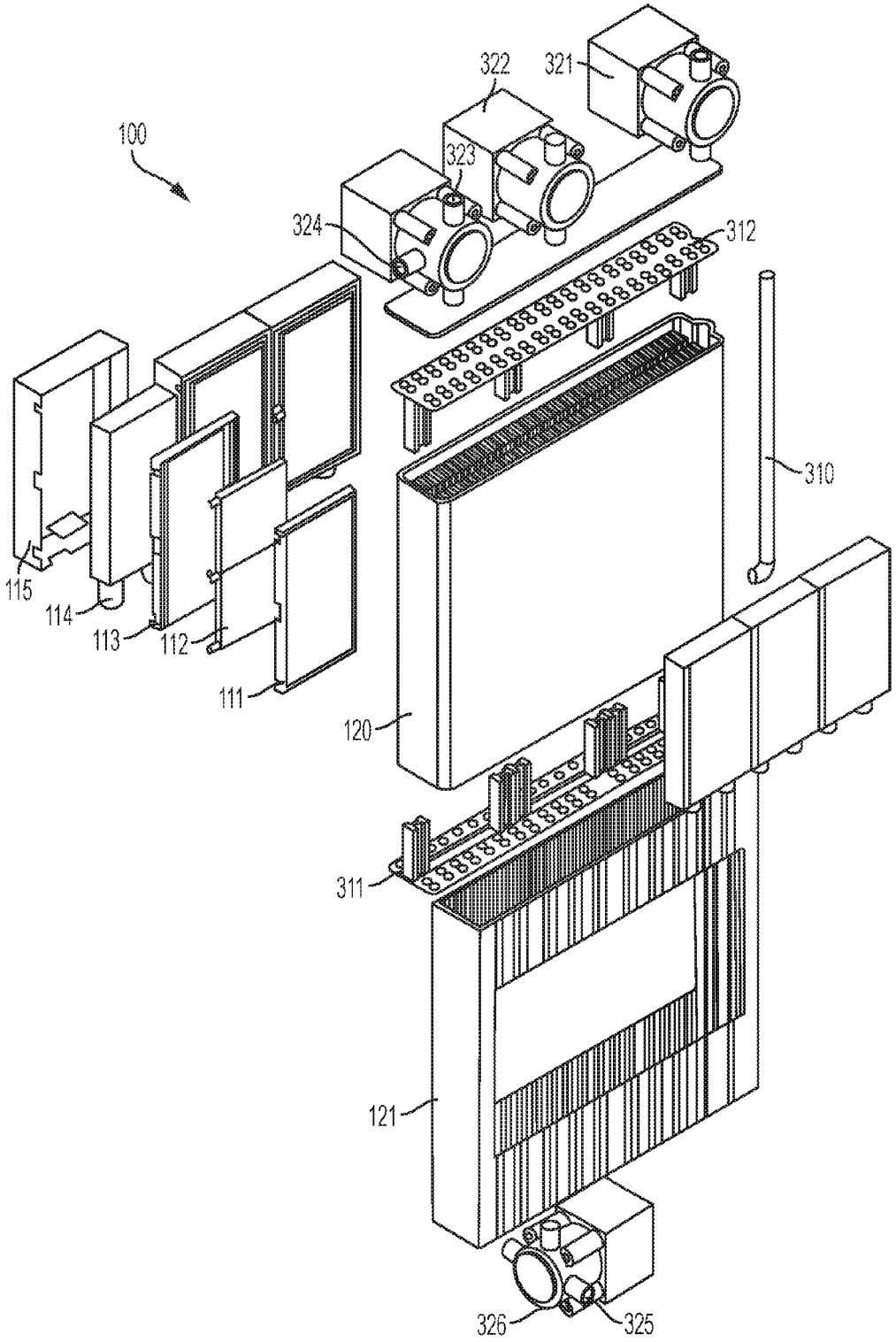
FIG. 13 shows an exploded view of the primary cooling and heating system of the rapid fluid chilling, heating, and dispensing machine from FIG. 12.

In one aspect of the invention, the fluid container 101 in the primary cooling and heating system 100 is a metal or other suitable material with thermal conductivity between 50 W/m-K and 450 W/m-K that may have a fluid inlet valve 322, a beverage inlet valve 321, a gas inlet valve 323, a gas outlet valve 324, a beverage outlet valve 325, and a waste outlet valve 326, an illustrative embodiment of which is shown in FIG. 12 from a perspective view, and FIG. 13 from an exploded view. The beverage inlet 321 may accept fluids other than beverages. The gas inlet 323 and gas outlet 324 may be combined in a three-way valve. The beverage outlet 325 and waste outlet 326 may be combined in a three-way valve. Each valve may be electrically actuated through a solenoid or other actuation device. The fluid container 101 and interior fluid heat sink or sinks 110 are combined into a single part through molding, casting, brazing, or other appropriate method. The combined interior fluid heat sink and fluid container 120 is connected directly through a first thermal interface material 111 to one or more thermoelectric devices 112. The thermoelectric device or devices 112 are connected through a second thermal interface material 113 on the opposite face of the thermoelectric device or devices 112 to one or more coolant circulating blocks 114. The assembly may be held together through compressive pressure or thermal adhesive.

The fluid container 101 in the primary cooling and heating system 100 may be enclosed in an insulator or insulating container with thermal conductivity of 1 W/m-K or less, but preferably 0.3 W/m-K or less, an illustrative embodiment of which is shown in FIG. 12 from a perspective view, and FIG. 13 from an exploded view. The fluid container insulating shell 121 may have one or more windows to allow contact with the fluid container 101 by the first thermal interface material 111. The fluid container insulating shell 121 may be used to prevent conductive and convective heat transfer through the fluid container 101 or combined interior fluid heat sink and fluid container 120 to the environment in embodiments of the fluid container 101 with thermal conductivity of 2 W/m-K or more.

Figure 14:
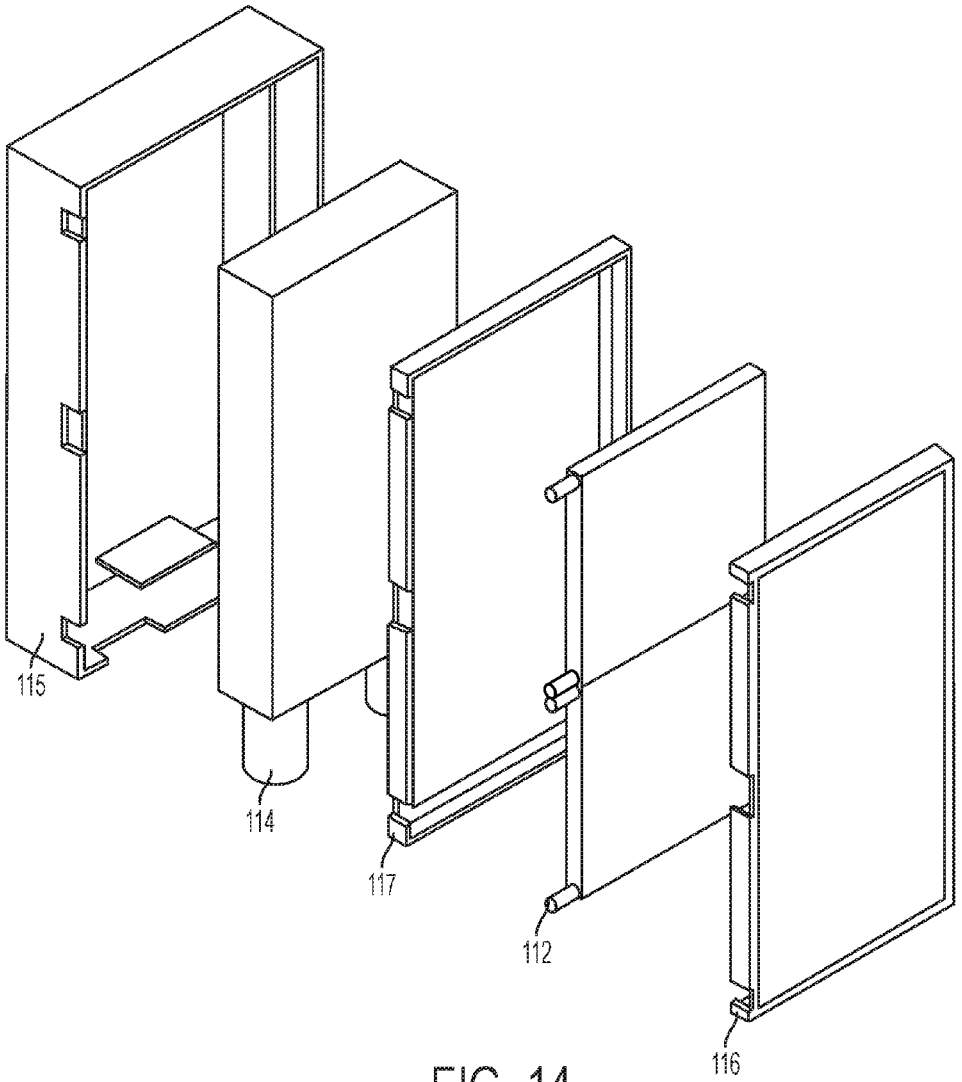
FIG. 14 shows an exploded view of an illustrative embodiment of the thermal interface in the primary cooling and heating system using thermal elastomers with retainers for assembly.

In one aspect of the invention, one or more retainers for the thermoelectric device or devices 112, the first thermal interface material 111, second thermal interface material 113, and the coolant circulating block or blocks 114 may be provided to allow ease of assembly of the rapid chilling, heating, and dispensing machine 001. FIG. 14 shows an illustrative embodiment with a first integrated thermal interface retainer 116, one or more thermoelectric devices 112, a second integrated thermal interface retainer 117, a coolant-circulating block 114, and an assembly retainer 115. The retainers may additionally have a foam or other elastomer to allow a compression fit and insulation between retainers, with thermal conductivity less than 0.8 W/m-K, or a small contact area to minimize thermal loss across the cold and warm thermoelectric junctions. Integrated thermal interface retainer 116 is composed of a plastic shell integrated with a thermal elastomer material with thermal conductivity of at least 1 W/m-K, but preferably 5 W/m-K or more, through over molding, adhesive, compression, screws, or other appropriate method. Integrated thermal interface retainer 117 is composed of a plastic shell integrated with a thermal elastomer material with thermal conductivity of at least 1 W/m-K, but preferably 5 W/m-K or more, through over molding, adhesive, compression, screws, or other appropriate method. The first integrated thermal interface retainer 116 may contact the thermoelectric device or devices 112. The second integrated thermal interface retainer 117 may contact the opposite side of the thermoelectric device or devices 112. The second integrated thermal interface retainer 117 may contact the coolant circulating block or blocks 114 on the opposite side. The assembly retainer 115 may contact the coolant circulating block or blocks 114. The first integrated thermal interface retainer 116 may be inserted into the second integrated thermal interface retainer 117. The first integrated thermal interface retainer 116 and second integrated thermal interface retainer 117 may be inserted into the assembly retainer 115. The remaining open side of the first integrated thermal interface retainer 116 contacts either the fluid container 101, interior fluid heat sink or sinks 110, or the combined interior fluid heat sink and fluid container 120.

In accordance with one aspect of the invention, the fluid chilling, heating, and dispensing system 001 is composed of two cooling systems including a primary cooling and heating system 100 that extracts or supplies heat directly to the fluid of interest and a secondary cooling and heating system 200. The secondary cooling and heating system 200 stores heat from the primary cooling and heating system 100 in cooling mode before expelling that heat to the environment at a rate that may be different from the heat transfer rate of the primary heating and cooling system. The secondary cooling and heating system 200 transfers stored heat to the primary heating and cooling system when in heating mode, drawing heat from the environment at a rate that may be different from the primary cooling and heating system 100 heat transfer rate.

Figure 15:
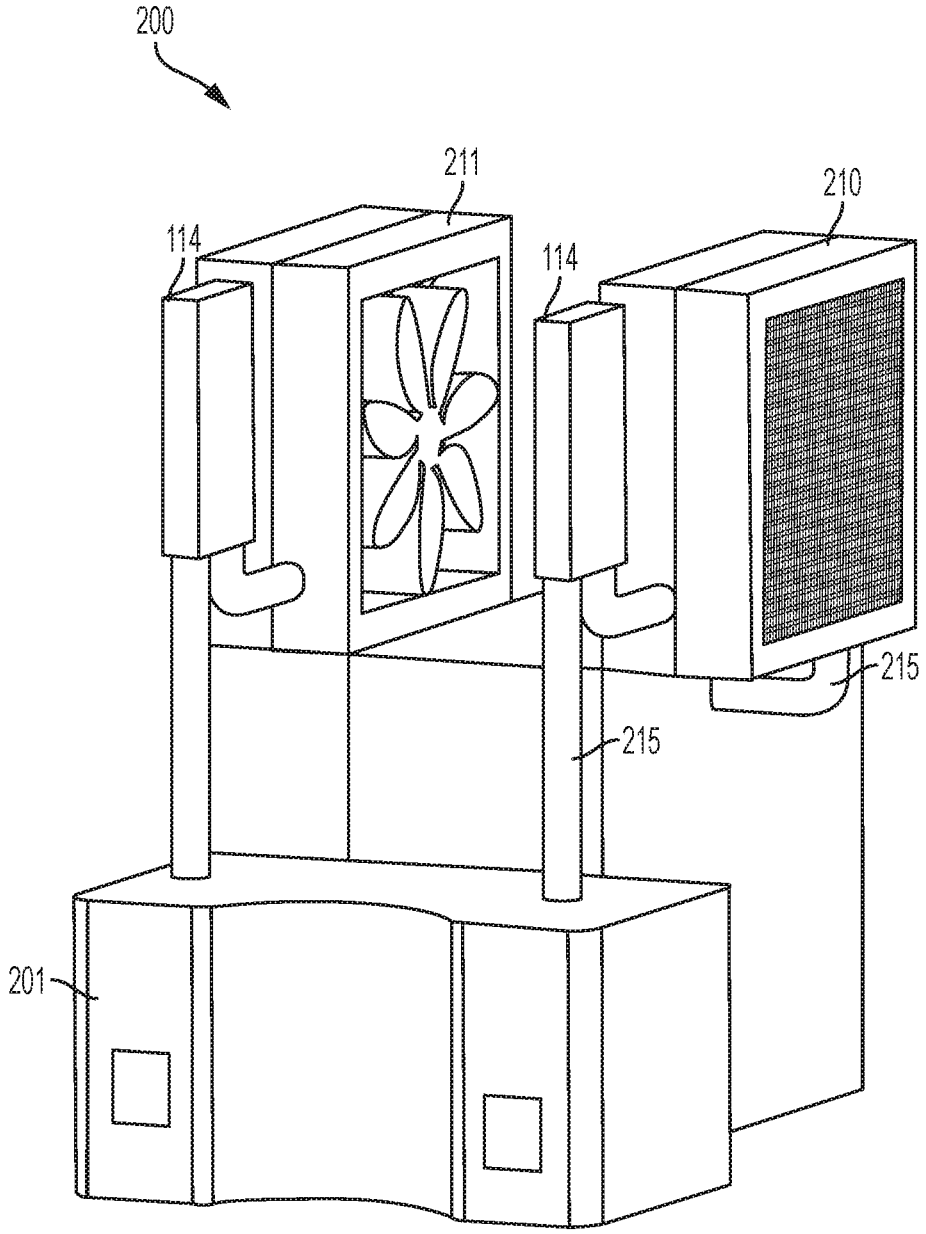
FIG. 15 shows a perspective view of an illustrative embodiment of the secondary cooling and heating system of a rapid fluid chilling, heating, and dispensing machine.
Figure 16:
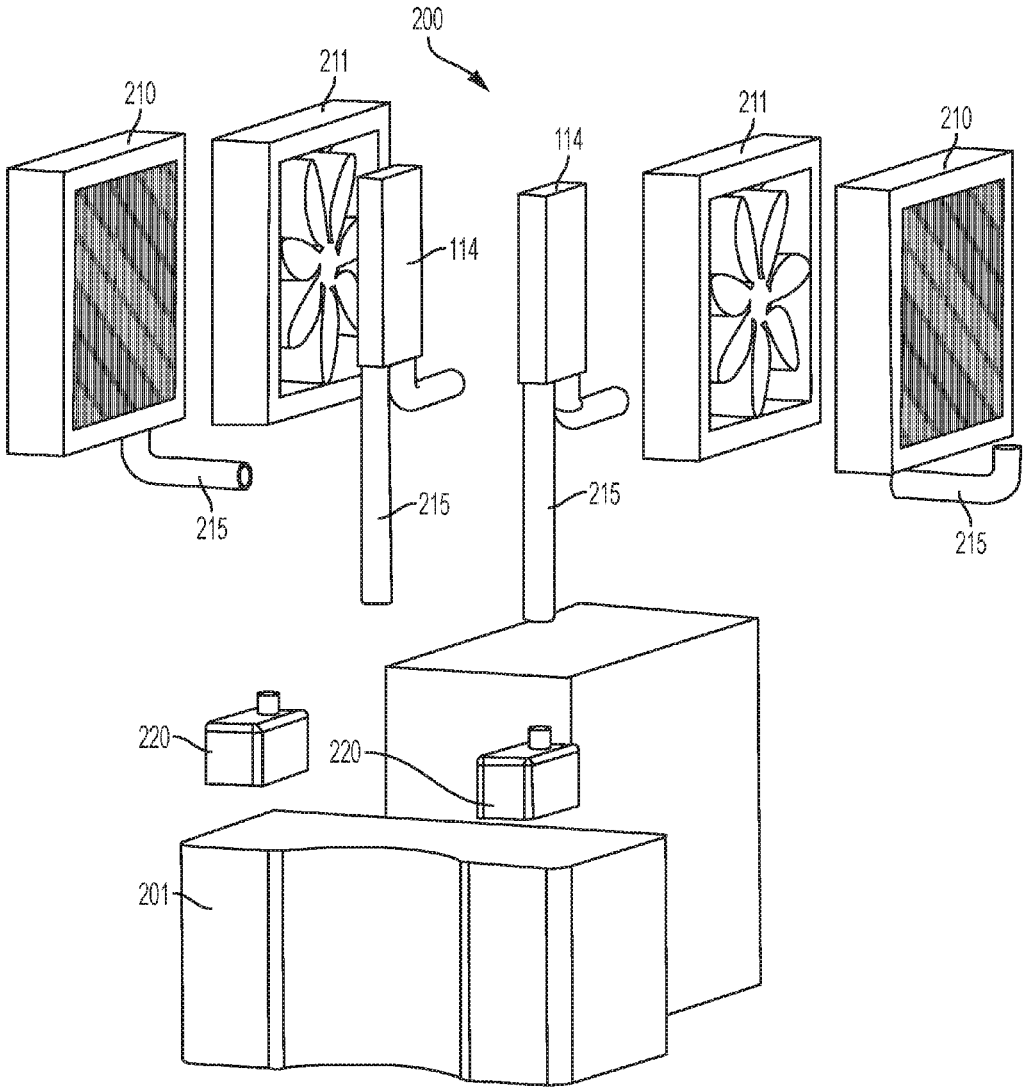
FIG. 16 shows an exploded view of an illustrative embodiment of the secondary cooling and heating system of a rapid fluid chilling, heating, and dispensing machine from FIG. 15.
Figure 17:
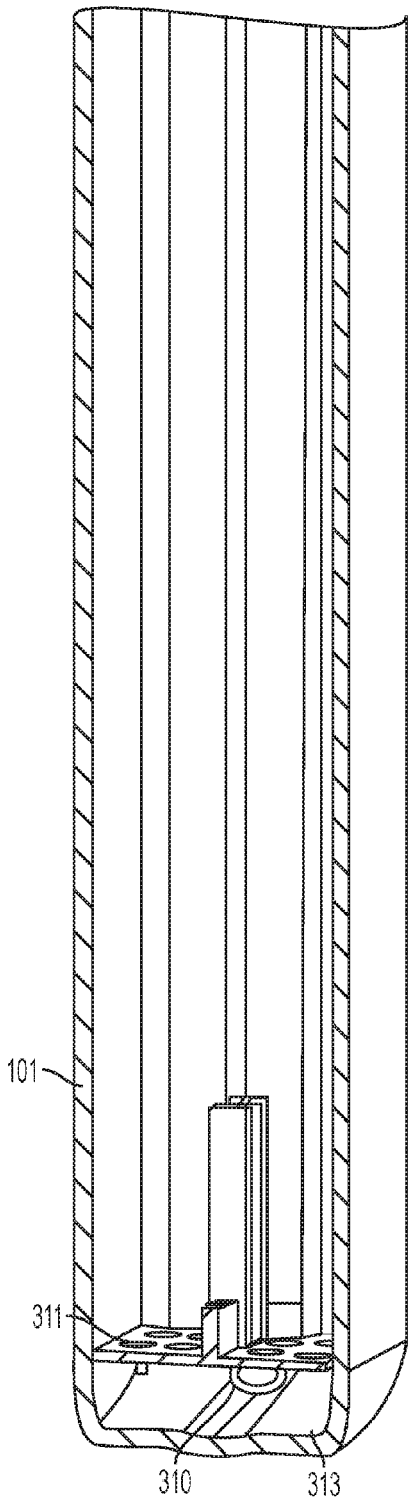
FIG. 17 shows a perspective cross-section of an illustrative embodiment of the fill portion of the fluid fill and control system.

In accordance with one aspect of the invention, as shown in the illustrative embodiment in FIG. 15 from a perspective view, and FIG. 16 from an exploded view, the secondary cooling and heating system 200 consists of a coolant reservoir 201, one or more radiators 210, one or more fans 211, one or more pumps 220, coolant tubing 215, and one or more coolant circulating blocks 114. The pump or pumps 220 circulate coolant from the coolant reservoir 201 through the coolant tubing 215 to the coolant-circulating block or blocks 114. The coolant absorbs or rejects heat through the coolant-circulating block or blocks 114 from the primary cooling and heating system 100. The heated or chilled coolant then travels through the radiator or radiators 210 where heat is partially rejected to or absorbed from the environment. The high surface area of the one or more radiators 210 allows the heat to be expelled to or absorbed from the environment by the forced air flow from the one or more fans 211 at a rate independent of the heat supply or absorption rate from the primary cooling and heating system 100. In addition, the coolant reservoir 201 may be connected to a coolant input valve and coolant output valve which may be coupled to an external coolant supply to cycle the reservoir coolant for higher continuous performance. The coolant input valve and coolant output valve may also connect to the fluid reservoir 410 and waste reservoir 411 to draw new coolant and expel used coolant. An additional input valve may be connected to the fluid reservoir 410 from an external source. An additional output valve may be connected to the waste reservoir 411 to supply to an external sink.

In accordance with one aspect of the invention, the coolant reservoir 201 is used to decouple the heat transfer rates between the primary cooling and heating system 100 and the secondary cooling and heating system 200. Decoupling the heat transfer rates between the two systems minimizes the decrease in primary cooling and heating system 100 heat transfer rate due to the temperature difference from hot to cold side of the thermoelectric device or devices 112 by minimizing coolant temperature change over the chilling or heating cycle. In addition, the coolant reservoir 201 permits heat transfer rates to be cycled for extended periods above the natural stable rate of the one or more radiators 210 and one or more fans 211, shrinking radiator instantaneous cooling requirements, and thus, cost and size. The capacity of the coolant reservoir 201 must be a minimum volume equivalent of the liquid volume to be cooled, but preferably five times or more, as the temperature change in the coolant reservoir is a direct function of the two heat transfer rates and the coolant reservoir 201 heat capacity. The coolant reservoir 201 size can be reduced with external coolant input and output lines connected to the coolant reservoir 201.

One or more thermoelectric devices 112 are used to pump heat from or to the fluid and all thermal bodies connected to the fluid through conduction, convention, or radiation. Thermoelectric devices have a maximum heat transfer rate that occurs when both sides of the device are at equal temperature. As the temperature difference between the opposite sides of the thermoelectric device increases, the amount of heat and thus the heat transfer rate of the thermoelectric device derates until it is no longer able to transport heat, typically at a temperature difference of 60 C to 70 C. It is desirable to maintain the hot side of the thermoelectric device at a known temperature such as ambient in order to pump heat at the maximum heat transfer rate of the thermoelectric device. Rejecting heat directly to the environment though convection is not effective at maintaining the hot side of the thermoelectric device at ambient or an optimal temperature, as convection requires a temperature difference between the hot surface of a heat sink or radiator and the ambient with heat rejected being linearly dependent on the hot side to ambient temperature difference. The heat pumped by the thermoelectric system will be derated until it comes to equilibrium with the convection system, limiting the heat transfer rate of the thermoelectric devices, potentially drastically. In the case that the thermoelectric devices are in an array, the heat transfer rate of the array and waste heat generated may, in addition to limiting the heat transfer rate, limit the achievable temperature difference the system may achieve.

The thermoelectric device waste heat can be as much as equal to the total heat removed from the rest of the system at maximum heat transfer rates, decreasing proportionally to decreases in the maximum transfer rate that occur from reducing electrical energy input. As the heat load for a 16 fluid ounce beverage chilled from 23 C to 3 C is approximately 40 kJ, the system experiences a thermal load due to the fluid, heat sinks, containers, and thermoelectric device waste heat of possibly 100 kJ or more. The required heat rejection rate of a convection system can be well over 1600 W to reject the heat over rapid time frames, such as approximately 1 minute. Even at an area of 5-10 $m^2$ there will still be a 10 C-20 C temperature difference between the hot side of the thermoelectric device or devices and ambient to stabilize the system. The required temperature difference reduces the thermoelectric device heat transfer rate substantially as well as requiring large, expensive radiators or heat sinks and fan systems, making a rapid chilling system intractable for commercial purposes. As thermoelectric device heat transfer rate and total achievable heat transfer is limited by hot side temperature and the cooling load of standard size beverages is large, decoupled cooling loops present a unique solution for cost and size effective cooling in on demand, intermittent, or burst fluid cooling applications.

A small forced air radiator system with a self-contained coolant reservoir that can store heat temporarily provides decoupling for the convective heat rejection requirement, shown in the illustrative embodiment of FIG. 15 and FIG. 16. The fluid in the coolant reservoir 201 stores or supplies heat, slowly changing its temperature as the fluid volume is a multiple of the volume of the fluid being chilled or heated. As the temperature of the coolant slowly changes, the temperature of the hot side of the thermoelectric device or devices 112 is held near ambient, at a lower and more stable temperature than convective heat transfer alone, allowing the thermoelectric device 112 heat transfer rate to be held near the maximum possible throughout the cooling or heating cycle. The convective portion of the system, the one or more radiators 210 and one or more fans 211, continues to expel or absorb heat during and after the cooling or heating cycle as necessary. Many beverages or other fluids can be dispensed sequentially at high thermal transfer rates, taking advantage of the time during pour and dispense to operate the system at the highest possible thermal transfer rates. In addition, external fluid sources can be supplied to the coolant reservoir 201 through coolant inlet and coolant outlet ports to allow maximum heat transfer rates for extended continuous or intermittent operation.

Figure 18:
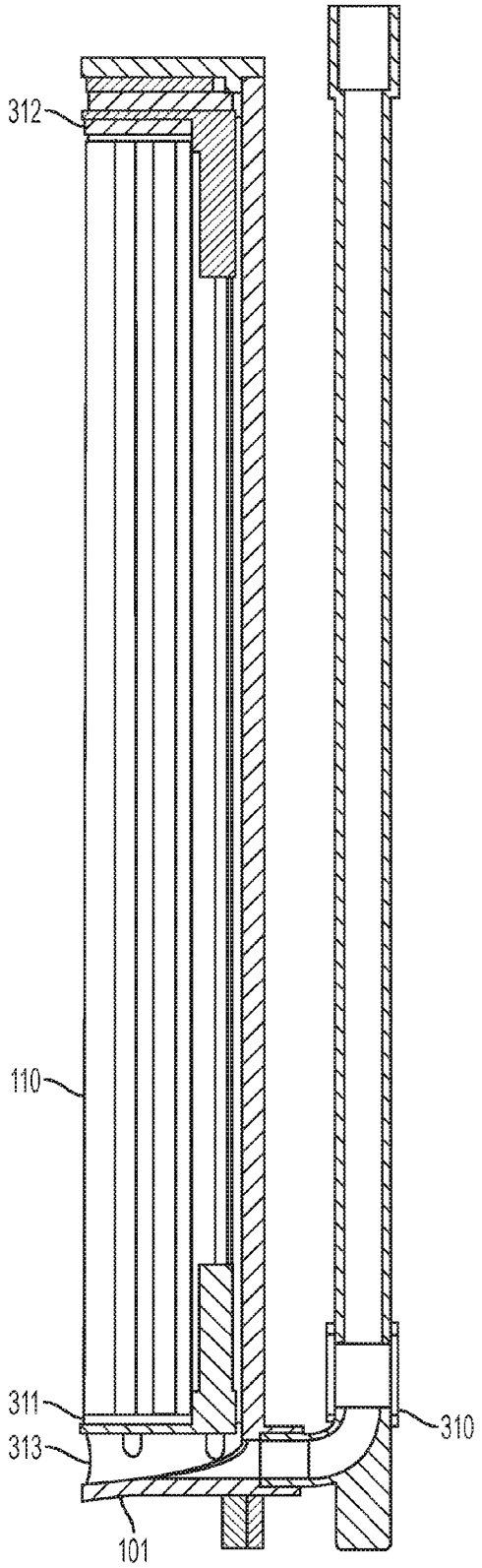
FIG. 18 shows a cross section of a second illustrative embodiment of the fill portion of the fluid fill and control system.

In accordance with another aspect of the invention, and as shown in the illustrative embodiment of FIG. 18 and FIG. 19, the fluid container 101 may have a near semicircle shape or smooth transitions from the fluid suppressor 311 to the base of the fluid container 101 defining the buffer volume 313. The transition is as close as feasible to semicircular, while limiting the buffer volume size 313, to minimize turbulent flow that increases foaming in some carbonated beverages. For fluid poured into the system through the funnel 331, as shown in FIG. 1 and FIG. 18, the fluid may enter the fluid container 101 from the top and be guided down a flow transition tube 310 to the buffer volume 313, or the flow transition tube 310 may be on the outside of the fluid container 101 before entering the buffer volume 313, shown in the illustrative embodiment in FIG. 19. The fluid container 101 may be positioned between vertical and as low as 15 degrees from horizontal for funnel 331 and pressurized use, while for pressurized only operation, the fluid container 101 may be positioned at any angle. The fluid flow rate is controlled through the diameter of the inlet and flow transition tube 310 to minimize foaming, with typical diameters between 4 mm and 12 mm, although other diameters are possible. The fluid fills the semicircular base buffer volume 313 before going through the fluid flow suppressor 311, which prevents direct contact with the interior fluid heat sink or sinks 110 surfaces during inflow and forces the fluid to rise at a slower rate, thereby minimizing friction and foaming in carbonated beverages. The flow suppressor 312 may be used for minimizing the volume of liquid needed for cleaning operations by spreading the liquid across the cross-sectional area of the fluid container 101.

In another embodiment of the invention, a hydrophobic, super hydrophobic, or oleo phobic filter, or a filter with a combination of these properties, is coupled to a portion of the fluid container 101 or the gas outlet valve 324 which allows air to pass through and vent, while preventing the liquid beverage from passing through. The filter can be additionally used to capture and remove any foaming that may occur.

Carbonated fluids such as beer pose unique difficulties to a chilling system as temperature changes cause changes in carbonation and carbonation saturation. Cooling a carbonated beverage requires a pressurized container to prevent loss of carbonation, or beverage flatness will occur altering the flavor of the beverage. For containers, such as cans, bottles, or kegs beverage flatness is usually not an issue. If the beverage is transferred to any other container it will immediately start to lose carbonation to the environment, at an increased rate with increased temperature. Cooling a carbonated beverage when exposed to the atmosphere will further drive carbonation out of the beer. Transferring a carbonated beverage from the original container to a new one, then sealing and chilling provides less carbonation loss but cannot maintain the original state of the beer. Preventing loss of carbonation requires fluid filling that minimizes friction and vortexing, sealing the chilling container, and establishing the proper atmosphere for carbonation to remain in fluid or return to the fluid during the chilling process.

In accordance with one aspect of the invention, the fluid container 101 has a gas inlet valve 323 and gas source 501 connected to the gas inlet valve 323 that is opened briefly establishing a carbonation environment in the fluid container 101 while chilling carbonated beverages. The fluid container 101 is opened to atmosphere through the gas outlet valve 324 after the fluid has been chilled. The fluid is then poured through the beverage outlet valve 325. Carbonation levels in the fluid can be varied through adjusting the time the gas source is in communication with the fluid container 101, or the pressure of the gas source 501, to allow user customization of the fluid taste. The user may control the carbonation levels via the interface on the machine, or via a remote interface as described above. The gas source 501 may be carbon dioxide or nitrogen. For non-carbonated beverages, the fluid container 101 may be left open to atmosphere during the chilling process.

In another embodiment of the invention, a dissolved carbon dioxide ($CO_2$) sensor can be coupled to the beverage inlet valve 321. The sensor can be configured to determine the carbonation level of a beverage being supplied to the beverage inlet valve 321, such as, for example, beer from a container, bottle, can, or keg. If the carbonation of the supplied beverage is not as a desired level, the controller can activate the gas inlet valve 323 to selectively supply gas to the beverage. A feedback loop can be used by the sensor to continually measure the carbonation level of the beverage environment until the desired beverage carbonation level is achieved. The controller can then close the gas inlet valve 323 accordingly.

In another embodiment of the invention, the fluid inlet valve 322 can supply water or any other non-carbonated liquid or beverage to the machine. The gas inlet valve 323 may be used to supply carbonation from the gas source 501, as described above, to the liquid. In this embodiment, however, the machine may be used to create a carbonated beverage from a non-carbonated beverage, in addition to providing a chilling or heating process.

In another embodiment of the invention, the fluid inlet valve 322 may be supplied with water from the fluid reservoir 410 through a filter to prevent buildup, scaling, or other fouling of the device and to provide filtered water.

In another embodiment of the invention, the fluid reservoir 410 may supply water via a pump either directly or through a filter to a pod, pouch, or other vessel containing beverage syrup, beverage powder, dehydrated beer, beer concentrate, liquor, powdered liquor, or another beverage precursor. The fluid inlet valve 322 may be supplied with the liquid that flows out from the pod, pouch, or vessel filling the fluid container 101. The gas inlet valve 323 may be used to supply carbonation from the gas source 501, as described above, to the liquid. In this embodiment, the machine may be used to create a carbonated beverage from non-carbonated water and beverage precursor, in addition to providing a chilling or heating process. For non-carbonated beverages, such as liquor drinks, juices, lemonade, or others, the gas inlet valve 323 may remain closed and the gas outlet valve 324 may remain open during the chilling or heating process. The beverage is dispensed from the fluid container 101 through the beverage outlet valve 325 into a serving container.

In another embodiment of the invention, the fluid reservoir 410 may supply water via a pump either directly or through a filter to the fluid inlet valve 322 filling the fluid container 101. The gas inlet valve 323 may be used to supply carbonation from the gas source 501, as described above, to the liquid. The water may be dispensed from the fluid container 101 through the beverage outlet valve 325 to a pod, pouch, or other vessel containing beverage syrup, beverage powder, dehydrated beer, beer concentrate, liquor, powdered liquor, or another beverage precursor. The carbonated liquid then pours into a serving container after exiting the pod, pouch, or vessel. In this embodiment, the machine may be used to create carbonated beverage from non-carbonated water and beverage precursor, in addition to providing a chilling or heating process. For non-carbonated beverages, such as liquor drinks, juices, lemonade, or others, the gas inlet valve 323 may remain closed and the gas outlet valve 324 may remain open during the chilling or heating process.

In another embodiment of the invention, the fluid inlet valve 322 may be supplied with water from the fluid reservoir 410 via a pump. The gas inlet valve 323 may be used to supply carbonation from the gas source 501, as described above, to the liquid. In this embodiment, however, the machine may be used to create carbonated water from non-carbonated water, in addition to providing a chilling or heating process. Carbonated water may be dispensed from the machine into a serving container by itself or into a serving container with a beverage precursor to make a carbonated beverage through mixing in the serving container.

In yet another embodiment of the invention, the fluid container 101 and/or the fluid inlet valve 322 may include a port or opening that receives a fluid enhancer, such as a flavoring, coloring, or nutritional supplement. For example, the fluid enhancer can include, but is not limited to, a dye, a, sweetener, sugar, a powder, a vitamin, a flavor essence, and an infused liquid.

In accordance with one aspect of the invention, to ensure safety and convenience, fluid from the fluid reservoir 410 may be pumped into the fluid container 101, and in some embodiments, the funnel 331. The waste outlet valve 326, or combined beverage outlet valve 325 and waste outlet valve 326, is opened to direct fluid to the waste reservoir 411. The waste outlet valve 326 and beverage outlet valve 325 may be integrated as a three-way valve. The waste reservoir 411 may have an external outlet valve. The fluid reservoir 410 may have an external inlet valve.

In an embodiment of the invention, the self-cleaning system and/or fluid reservoir 411 are coupled to an external water supply line via the external inlet valve that provides water for the self-cleaning process. The external water supply line may also be coupled to the coolant reservoir 201 to provide a constant supply of new coolant to the device. The external supply line may also be connected upstream to the fluid inlet valve 322 to provide a continuous, uninterrupted source of water for cleaning purposes, as well as to provide heating or cooled water to the user.

In accordance with one aspect of the invention, a fluid is poured from its container into a funnel 331. The fluid may be beer, liquor, water, soda, wine, oil, or other liquid. The bottom of funnel 331 is positioned above the top of primary cooling and heating system 100. The fluid flows through the funnel 331, forced by hydrostatic pressure. The gas inlet valve 323 is open to the environment during pour. In some embodiments, the funnel 331 connects to the top of the fluid container 101 through a tube to the beverage inlet valve 321. The beverage inlet valve 321 is connected to a flow transition tube 310 to guide fluid to the buffer volume 313 at the bottom of the fluid container 101 in a laminar path. In other embodiments, the funnel 331 connects through a flow transition tube 310 to the bottom of the fluid container 101 through the beverage inlet valve 321, which is in communication with the buffer volume 313. The fluid is blocked from inrush contact with the interior fluid heat sinks or heat sinks 110 by a flow suppressor 311.

Hydrostatic pressure causes beer to fill the fluid container 101 while the beverage outlet valve 325 prevents outflow. After filling the buffer volume 313 under the flow suppressor 311, the fluid rises through the fluid container 101 at a lower velocity minimizing foaming. If the fluid is carbonated the primary cooling and heating system 100 is sealed and/or pressurized with carbon or nitrogen mixtures according to beverage or user requirements through a gas canister or other gas source 501 that is connected to the gas inlet valve 323. The gas inlet valve 323 and gas outlet valve 324 may be a combined three-way valve. The primary cooling and heating system 100 and secondary cooling and heating system 200 is powered on in cooling mode, extracting heat from the fluid at a predetermined rate. After the desired energy is extracted from the fluid, the beverage outlet valve 325 and the gas outlet valve 324 open, pouring the fluid into a serving container. The primary cooling and heating system 100 ideally reduces its cooling rate during the fluid pour and is powered off after the fluid is poured into the serving container, although other sequences are possible. The secondary cooling and heating system 200 remains on for a period of time after the pour until it reaches the predetermined temperature setting. A temperature sensor may be used, or predetermined timing, in order to set the operational time of the primary cooling and heating system 100 and the secondary cooling and heating system 200. The beverage outlet valve 325 and waste outlet valve 326 may be a three-way valve and further may be electronically controlled. The machine may perform a cleaning cycle after chilling one or more beverages. During a cleaning cycle, fluid is taken from the fluid reservoir 410 and pumped into the funnel 331 and/or primary cooling and heating system 100, and then released to a waste reservoir 411 through the waste outlet valve 326. It should be obvious to those in the field that additional valves may be combined.

In an embodiment of the invention, the fluid reservoir 410 may have an access port that allows the user to add a fluid or cleaning solution, such as detergent, a descaling solution, anti-microbial solution, or any other sanitizing solutions or chemicals. The cleaning solutions can then be cycled through the machine as described above.

In an embodiment of the invention, the machine can include a controller coupled to the self-cleaning system. The controller may automatically activate a self-cleaning operation after a pre-set number of uses of the machine. For example, the controller can increment a counter each time the machine is used to cool, heat, or carbonate a liquid. After, for example, ten uses, the self-cleaning operation is automatically executed without requiring user intervention. In another embodiment of the invention, the self-cleaning operation may be activated after each use of the machine, or based on a timer interval, such as daily, weekly, bi-monthly, monthly, or quarterly.

In accordance with one aspect of the invention, a pressurized fluid container such as a keg is connected to the primary cooling and heating system 100. The fluid may be beer, liquor, water, soda, wine, oil, or other fluid. The gas outlet valve 324 and beverage inlet valve 321 are opened allowing the fluid to flow into the fluid container 101 through applied pressure. In some embodiments, the keg connects to the top of the fluid container 101 through an external tube to the beverage inlet valve 321. The beverage inlet valve is connected to a flow transition tube 310 to guide fluid to the buffer volume 313 at the bottom of the fluid container 101 in a laminar path. The laminar path may include, for example, laminar flow transitions, flow suppressor 311 and/or flow suppressor 312, and flow regulators. In other embodiments, the keg connects to the bottom of the fluid container 101 through a flow transition tube 310 on the outside of the fluid container 101 to the beverage inlet valve 321, which is in communication with the buffer volume 313. The fluid is blocked from inrush contact with the interior fluid heat sinks or heat sinks 110 by flow suppressor 311.

Applied pressure causes beer to fill the fluid container 101 while the beverage outlet valve 325 prevents outflow. After filling the buffer volume 313 under the flow suppressor 311, the fluid rises through the fluid container 101 at a lower velocity minimizing foaming. If the fluid is carbonated the primary cooling and heating system 100 is sealed and/or pressurized with carbon or nitrogen mixtures according to beverage or user requirements through a gas canister or other gas source 501 that is connected to the gas inlet valve 323. The gas inlet valve 323 and gas outlet valve 324 may be a combined three-way valve. The primary cooling and heating system 100 and secondary cooling and heating system 200 is powered on in cooling mode, extracting heat from the fluid at a predetermined rate. After the desired energy is extracted from the fluid, the beverage outlet valve 325 and the gas outlet valve 324 open, pouring the fluid into a serving container. The primary cooling and heating system 100 ideally reduces its cooling rate during the fluid pour and is powered off after the fluid is poured into the serving container, although other sequences are possible. The secondary cooling and heating system 200 remains on for a period of time after the pour until it reaches the predetermined temperature setting. A temperature sensor may be used, or predetermined timing, in order to set the operational time of the primary cooling and heating system 100 and the secondary cooling and heating system 200. The beverage outlet valve 325 and waste outlet valve 326 may be a three-way valve and further may be electronically controlled. The machine may perform a cleaning cycle after chilling one or more beverages. During a cleaning cycle, fluid is taken from the fluid reservoir 410 and pumped into the primary cooling and heating system 100, then released to a waste reservoir 411 through the waste outlet valve 326. It should be obvious to those in the field that additional valves may be combined.

In accordance with one aspect of the invention, a pressurized fluid such as a keg is connected to the fluid inlet valve 322. The fluid inlet valve 322 and beverage outlet valve 325 are opened to allow fluid flow. Applied pressure causes beer to fill the fluid container 101 until only fluid is left in the fluid container 101, at which time the beverage outlet valve 325 seals. The fluid inlet valve 322 may also seal. The primary cooling and heating system 100 and secondary cooling and heating system 200 is powered on in cooling mode, extracting heat from the fluid at a predetermined rate. After the desired energy is extracted from the fluid, the beverage outlet valve 325 opens, and if the fluid inlet valve 322 is closed, it is opened, pouring the fluid into a serving container. The primary cooling and heating system 100 ideally reduces its cooling rate during the fluid pour and is powered off after the fluid is poured into the serving container, although other sequences are possible. The secondary cooling and heating system 200 remains on for a period of time after the pour until it reaches the predetermined temperature setting. A temperature sensor may be used, or predetermined timing, in order to set the operational time of the primary cooling and heating system 100 and the secondary cooling and heating system 200. In addition, a coolant source and a coolant sink may be connected to the coolant reservoir 201 to allow cycling or replacement of the heated coolant for high volume operation, or reduction of device footprint for tight spaces.

In another embodiment of the invention, multiple kegs may be connected to a downstream valve. The downstream valve is then connected through a tube to the beverage inlet valve 321 or the fluid inlet valve 322. The downstream valve can be used to selectively supply beer from a particular keg to the machine. The downstream valve may be manually actuated, or actuated electronically via, for example, a mobile device, smartphone, tablet, portable computing device, or point-of-sale system, or flow control system.

In accordance with one aspect of the invention, water or other fluid may be supplied to the fluid container 101 from the fluid reservoir 410 by a pump through the fluid inlet valve 322. The fluid container 101 is filled with water or other fluid to the desired volume. The gas outlet valve 324 may be opened to allow fill. The primary cooling and heating system 100 and secondary cooling and heating system 200 is then powered on in reverse polarity, or heating mode, extracting heat from the coolant at a predetermined rate. The heat from the coolant and the thermoelectric device or devices 112 waste heat are pumped into the fluid in the fluid container 101. After the desired energy is added to the fluid, the beverage outlet valve 325 opens pouring the fluid into a serving container. The primary cooling and heating system 100 ideally reduces its heating rate during the fluid pour and is powered off after the fluid is poured into the serving container, although other sequences are possible. The secondary cooling and heating system 200 remains on for a period of time after the pour until it reaches the predetermined temperature setting. A temperature sensor may be used, or predetermined timing, in order to set the operational time of the primary cooling and heating system 100 and the secondary cooling and heating system 200. The primary cooling and heating system 100 may be run with normal polarity, in cooling mode, to set the primary cooling and heating system 100 back to ambient when switching between heating and cooling.

In yet another embodiment, the beverage outlet valve 325 can be coupled to a secondary container that temporarily stores a cooled or heated beverage. For example, in a bar environment, the secondary container can be a chilled, temperature controlled container that stores chilled beer. The container can have an outlet coupled to a beer tap. As a beer tap is actuated by the user, chilled beer can instantly be served from the secondary container. In an embodiment, the secondary container can include a fill sensor coupled to the controller. The controller can determine when additional beer is required to replenish the secondary container, and can automatically actuate the fluid inlet valve or beverage inlet valve. This feature can provide a similar experience as with using a traditional beer tap in that beer is instantaneously dispensed.

In another embodiment of the invention, the machine is integrated within a casing or cabinet of a beer tap to provide a seamless and unified appearance with existing bar furniture and infrastructure.

In another embodiment of the invention, the machine is a tabletop device which can be coupled to external water and beverage supply lines, or which is a standalone device which can accept a poured beverage and/or water, but may or may not be coupled to an external supply line. The device can be configured to be coupled to a vehicle fluid supply line, such as in a camper, recreational vehicle (RV), bus, boat, or airplane. In such an embodiment, water, beverages, and/or cleaning fluid can be supplied by an on-board vehicle fluid reservoir.

In yet another embodiment of the invention, the machine may be integrated within a residential or commercial refrigerator, such as within a door or body panel. In such an embodiment, the machine may share a water supply, radiator, and other electrical components with the refrigerator.

The machine may be powered via a plug coupled to an electrical outlet on, for example, a wall, a vehicle power supply, or an external power supply such as a battery pack or a generator. An internal power supply and control unit 601 converts and controls the power for the thermoelectric device or devices 112. In addition, the internal power supply and control unit 601 may provide control of sensors, feedback loops, and user input systems. In another embodiment of the invention, the machine may include solar power means that provide primary or secondary energy to the machine.

Having thus described several aspects of at least one embodiment of this invention, it is to be appreciated that various alterations, modifications, and improvements will readily occur to those skilled in the art. Such alterations, modifications, and improvements are intended to be part of the disclosure and are intended to be within the spirit and scope of the invention. Accordingly, the foregoing description and drawings are by way of example only.

What is claimed is:

1. A fluid chilling, heating and dispensing machine, comprising: a fluid container; a beverage inlet coupled to the fluid container and configured to receive a beverage, and further configured to direct the beverage into the fluid container;

a primary cooling and heating system having at least one thermoelectric device coupled to the fluid container, and configured to selectively remove heat from the beverage and supply heat to the beverage, wherein a primary heat transfer conducted by the primary cooling and heating system occurs at a first heat transfer rate; and a secondary cooling and heating system having a coolant reservoir, the secondary cooling and heating system coupled to the primary cooling and heating system via at least one coolant circulating block, the secondary cooling and heating system further configured to selectively remove heat from a device located within the primary cooling and heating system, wherein the device is selected from a group consisting of the thermoelectric device, the beverage container, a heat sink, and a thermal interface, and the secondary cooling and heating system further configured to supply heat to the device located within the primary cooling and heating system, wherein a secondary heat transfer to an external environment conducted by the secondary cooling and heating system occurs at a second heat transfer rate different from the first heat transfer rate.

2. The machine of claim 1, wherein the secondary cooling system includes a coolant in the coolant reservoir, wherein the volume of the coolant is greater than or equal to the volume of the beverage in the fluid container.

3. The machine of claim 1, wherein at least one of the beverage inlet and the fluid container includes a laminar flow path.

4. The machine of claim 1, further comprising a fluid reservoir coupled to at least one of the fluid inlet and the fluid container.

5. The machine of claim 1, wherein the primary cooling and heating system includes a heat sink comprised of a plurality of projections spaced 1 to 8 millimeters from one another, wherein each projection has a length of 3 to 20 millimeters, and wherein each projection has a width of 0.1 to 3 millimeters.

6. The machine of claim 5, wherein the at least one thermoelectric device is coupled to the interior fluid heat sink via a first thermal interface and to a coolant circulation system via a second thermal interface.

7. The machine of claim 5, wherein the projections are selected from a group consisting of pins and fins.

8. The machine of claim 5, wherein the interior fluid heat sink is integrated with the fluid container, wherein the fluid container has a high thermal conductivity of at least 2 W/m-K.

9. The machine of claim 8, wherein the at least one thermoelectric device is coupled to the beverage container via a first thermal interface and to a coolant circulation system via a second thermal interface.

10. The machine of claim 1, further comprising a gas inlet configured to supply carbonation or nitrogen to the fluid.

11. The machine of claim 1, further comprising a beverage inlet having a first end and a second end, where the first end is coupled to a fluid reservoir, and wherein the second end is coupled to the fluid container.

12. The machine of claim 1, wherein the fluid container includes a beverage outlet that is coupled to a beverage dispensing mechanism.

13. The machine of claim 1, further comprising a controller configured to automatically actuate a cooling process, a heating process, a self-cleaning process, a carbonation process, or a fluid reservoir filling process.

14. A beverage chilling and dispensing machine, comprising: a fluid container; a beverage inlet coupled to the fluid container and configured to receive a beverage, and further configured to direct the beverage into the fluid container; a primary cooling system having at least one thermoelectric device coupled to the fluid container, and configured to remove heat from the beverage at a first heat transfer rate;

a secondary cooling system having a coolant reservoir, the secondary cooling system coupled to the primary cooling system via a coolant circulating block, and configured to remove heat from at least one device located within the primary cooling system, wherein the device is selected from a group consisting of the at least one thermoelectric device, the beverage container, a heat sink, and a thermal interface, and expel the heat to the environment at a second heat transfer rate; and a gas supply system coupled to the fluid container and configured to supply carbonation or nitrogen to the beverage.

15. The machine of claim 14, wherein the secondary cooling system includes a coolant in a coolant reservoir, wherein the volume of the coolant is greater than or equal to the volume of the beverage in the fluid container.

16. The machine of claim 14, wherein the primary cooling and heating system includes a heat sink comprised of a plurality of projections spaced 1 to 8 millimeters from one another, wherein each projection has a length of 3 to 20 millimeters, and wherein each projection has a width of 0.1 to 3 millimeters.

17. A fluid chilling and dispensing system, comprising:

a fluid container configured to receive a first fluid from a remote container via a fluid supply line;

a primary cooling system having at least one thermoelectric device coupled to the fluid container, and configured to remove heat from the first fluid; and a secondary cooling system having a coolant reservoir, the secondary cooling system coupled to the primary cooling system via a coolant block and configured to remove heat from at least one device located within the primary cooling system, wherein the at least one device is selected from a group consisting of the at least one thermoelectric device, the fluid container, a heat sink, and a thermal interface.

18. The system of claim 17, wherein the remote container is selected from a group consisting of a keg, barrel, and beverage storage container.

19. The system of claim 17, further comprising an inlet valve coupled to the fluid supply line, wherein the inlet valve is further coupled to a second fluid supply line configured to provide a second fluid, wherein the inlet valve is configured to selectively direct the first fluid and the second fluid into the fluid container.

20. The system of claim 17, further comprising a fluid outlet coupled to a dispensing mechanism.

* * * * *